US005729269A

United States Patent [19]

Ohnishi et al.

[11] Patent Number: 5,729,269

[45] Date of Patent: Mar. 17, 1998

[54] EXPOSURE DEVICE UTILIZING LEDS EACH HAVING A PLURALITY OF LUMINESCENCE PORTIONS

[75] Inventors: Kazuyuki Ohnishi, Yamatokoriyama; Toshiaki Kobayashi, Tenri; Hideo Matsuda, Nara; Osamu Fujimoto, Yamatokoriyama, all of Japan

[73] Assignee: Sharp Kabushiki Kaisha, Osaka, Japan

[21] Appl. No.: 571,186

[22] Filed: Dec. 12, 1995

[30] Foreign Application Priority Data

Dec. 27, 1994 [JP] Japan ..... 6-326369

[51] Int. Cl.[6] ..... B41J 2/45

[52] U.S. Cl. ..... 347/130; 347/129; 347/238; 347/251; 399/177; 358/296; 257/88; 313/500

[58] Field of Search ..... 358/296, 298, 358/300, 459; 399/177; 347/129, 130, 251, 252, 238, 240; 257/88, 89; 313/499, 500

[56] References Cited

U.S. PATENT DOCUMENTS

| | | | |
|---|---|---|---|
| 4,126,812 | 11/1978 | Wakefield | 257/88 |
| 4,734,747 | 3/1988 | Okuda et al. . | |
| 4,831,412 | 5/1989 | Ohnishi et al. . | |
| 4,989,038 | 1/1991 | Kobayashi et al. . | |
| 5,061,974 | 10/1991 | Onodera et al. | 257/88 |
| 5,121,146 | 6/1992 | Smith et al. | 257/88 |
| 5,373,174 | 12/1994 | Yamamoto | 257/88 |

FOREIGN PATENT DOCUMENTS

| | | | |
|---|---|---|---|
| 62-179962 | 8/1987 | Japan . | |
| 62-184868 | 8/1987 | Japan . | |
| 63-270167 | 11/1988 | Japan . | |
| 4-28572 | 1/1992 | Japan | B41J 2/44 |
| 4-31877 | 2/1992 | Japan . | |
| 4-31877 | 4/1992 | Japan | G03G 15/04 |
| 4-148573 | 5/1992 | Japan | H01L 33/00 |
| 4148573 | 5/1992 | Japan . | |
| 5-55629 | 3/1993 | Japan | H01L 33/00 |
| 555629 | 3/1993 | Japan . | |

*Primary Examiner*—Peter S. Wong
*Assistant Examiner*—Derek J. Jardieu

[57] ABSTRACT

An image forming apparatus is provided with a photoreceptor, and an exposure device for exposing the photoreceptor based on image data so as to form an electrostatic latent image on the photoreceptor. The exposure device has a plurality of light emitting devices aligned along a main scanning direction of the photoreceptor, the respective light emitting devices having a plurality of luminescence portions, and a light emitting device driver for applying a voltage to the respective luminescence portions so that the luminescence area of the light emitting device increases step by step whenever the applied voltage increases by a predetermined voltage based on the image data. With the arrangement, tone expression is realized in the electrostatic latent image, according to the size of the luminescence area of the respective light emitting devices, which can be controlled by the voltage applied to the respective light emitting devices based on the image data. Accordingly, it is possible to form the electrostatic latent image having many tones on the photoreceptor based on image data accurately and easily.

32 Claims, 17 Drawing Sheets

8
20
17
18
54
50

50
50
50p
50m
50a
50o

EXPOSURE DEVICE UTILIZING LEDS EACH HAVING A PLURALITY OF LUMINESCENCE PORTIONS

BACKGROUND OF THE INVENTION

1. Field of the Invention

The present invention relates to an image forming apparatus, which uses electrophotography, such as a printer, a copying machine, and a facsimile machine.

2. Description of the Background Art

An image forming apparatus, which uses electrophotography, such as a printer, a copying machine, and a facsimile machine, is required to form an image having tones, i.e., to realize tone expression, to enable improvement of image quality of the apparatus. The digital copying machine is, in particular, required to realize tone expression.

A conventional image forming apparatus using electrophotography is provided with an exposure means which exposes a photoreceptor using light emitting devices so as to form an electrostatic latent image on the photoreceptor. In the exposure means, a light emitting diode (i.e., an LED) is used as the light emitting device, and the following various methods are adopted in order to realize the tone expression by forming the electrostatic latent image having many tones on the photoreceptor based on inputted image data including data for tone.

1. The tone expression is carried out in such a manner that an electric current for driving the LED is changed in order to change luminescence intensity. This results in that the density of dots formed on the photoreceptor is changed (see Japanese unexamined patent publication No. 62-179962/1987).
2. The tone expression is carried out in such a manner that luminescence period of the LED is changed. This results in that the area of dots formed on the photoreceptor is changed (see Japanese unexamined patent publication No. 62-184868/1987).
3. The tone expression is carried out in such a manner that there is provided a specific filter for filtering the light emitted from the LED. This results in that the area of dots formed on the photoreceptor is changed (see Japanese unexamined patent publication No. 4-31877/1992).
4. The tone expression is carried out in such a manner that, by the contrivance of LED electrodes, (1) the luminous power is non-uniformly changed depending on a luminescence part or (2) the luminescence part is changed. This results in that luminous power or luminescence area is changed (see Japanese unexamined patent publication Nos. 4-28572/1992 and 4-148573/1992).

In the case of carrying out the tone expression, there exists unevenness of the luminous power among the respective LEDs. In order to correct this unevenness of the luminous power, correction data are prepared beforehand and either the inputted image data or the electric current for driving the LED is corrected. This method is disclosed in Japanese unexamined patent publication No. 63-270167/1988.

However, in the first type of tone expression, i.e., the tone expression based on the change of luminescence intensity, the unevenness of the luminous power of the LED is comparatively great, and it is thus necessary to provide a circuit for correcting such an unevenness of the respective LEDs. Moreover, for the correction, it is necessary to measure the respective characteristics among thousands of LEDs aligned at intervals of sixty microns, thereby making fabrication of the exposure means, or the so called LED head, difficult.

In the second type of tone expression, i.e., the tone expression based on the change of luminescence period, the length of the dot formed on the photoreceptor in the sub scanning direction is changed so as to express many tones through the control of an exposure area. Therefore, when the photoreceptor has a high gamma ($\gamma$) value with respect to photosensitivity, it is possible to prevent unevenness of density due to the unevenness of luminescence intensity. However, in order to control the luminescence period of the respective LEDs among thousands of LEDs, it is necessary to provide circuits, such as shift registers, thereby presenting the problem that high integration of LED drive circuits, or so called driver ICs, is required.

In the third type of tone expression, i.e., the tone expression by providing the specific filter so as to change the luminous power and to form the latent image having various lengths of dots on the photoreceptor, it is difficult to fabricate a filter in which transmission ratio changes within a small amount of range. Moreover, it is necessary to align the position of the filter with the position of the LED. Unevenness of the filter must also be considered, adding to the unevenness of luminescence intensity.

In the fourth type of tone expression, i.e., the tone expression based on the contrivance of the LED electrode, it is necessary to form the LED electrode peculiarly and to form a plurality of electrodes.

SUMMARY OF THE INVENTION

The present invention is made in the light of foregoing problems, and provides an image forming apparatus which can form an electrostatic latent image having many tones on a photoreceptor based on image data, accurately, precisely and easily.

In order to achieve the foregoing object, an image forming apparatus of the present invention is provided with a photoreceptor, and an exposure device for exposing the photoreceptor based on image data so as to form an electrostatic latent image on the photoreceptor, wherein the exposure device has a plurality of light emitting devices aligned in a main scanning direction of the photoreceptor, the respective light emitting devices having a plurality of luminescence portions, and a light emitting device driver for applying a voltage to the respective luminescence portions in accordance with the image data so that a luminescence area of the light emitting device increases step by step each time the applied voltage increases by a predetermined voltage.

According to the foregoing image forming apparatus, the light emitting device driver controls the voltage applied to the respective light emitting devices based on the image data so as to easily control the luminescence area of the respective light emitting devices. A plurality of luminescence portions in the respective light emitting devices are different from each other in their luminescence starting voltages. Accordingly, the number of the luminescence portions which emit light increases in the respective light emitting devices, as the voltage applied to the respective light emitting devices increases. In other words, the luminescence area of the respective light emitting devices increases step by step, with the increase in the voltage applied to the respective light emitting devices.

When the photoreceptor is exposed to the light emitted by the respective light emitting devices, the electrostatic latent image is formed on the photoreceptor. Accordingly, tone expression is realized according to the size of the luminescence area of the respective light emitting devices.

In this way, it is possible to form the electrostatic latent image having many tones on the photoreceptor based on image data, accurately, precisely and easily.

The luminescence area can increase not only in the main scanning direction but also in the sub scanning direction, thereby realizing a finer (more detailed) tone expression.

It is preferable that the first luminescence portion, which first emits light in the respective light emitting devices, has a luminescence area of not less than the diameter of a toner particle. With this arrangement, even when the image data corresponding to the faintest density are inputted, the toner particle can adhere to the photoreceptor, thereby realizing the tone expression.

It is also preferable that the luminescence area of the respective light emitting devices increases step by step so as to spread from the central part of the respective light emitting devices toward the periphery thereof. In other words, when the minimum voltage required for emitting light is applied to the respective light emitting devices, its central part first emits light, and the luminescence area spreads over toward the periphery step by step, with the increase in the applied voltage.

With this arrangement, the size of each dot of the electrostatic latent image increases step by step from its center. Accordingly, it is possible to improve a reproductivity of a toner image and to realize a smooth tone expression.

It is also preferable that at least adjacent first and second types of light emitting devices respectively make a set among a plurality of light emitting devices provided in the exposure device; one type of light emitting device is arranged so that its luminescence area is increased in one direction along the main scanning direction by its respective luminescence portions, while the other type of light emitting device is arranged so that its luminescence area is increased in the reverse direction by its respective luminescence portions.

With this arrangement, with the increase in the applied voltage, the respective luminescence portions of one type of light emitting device and the other type of light emitting device start to emit light from the connecting part of the two light emitting devices and the luminescence area increases so as to spread over the both sides along the main scanning direction.

According to the luminescence area of the two light emitting devices, each dot of the electrostatic latent image is formed so that the formation is centralized every two light emitting devices. As the luminescence area increases, each dot of the electrostatic latent image increases, maintaining its centralized shape, up to the maximum luminescence area by the two light emitting devices.

Accordingly, it is possible to improve a reproductivity of a toner image and to realize a smooth tone expression.

It is also preferable that there is provided an optical filter, between the light emitting device and the photoreceptor, which has the characteristics that its transmission ratio decreases according to the change of the luminescence wavelength due to the increase in the luminous power of the light emitting device. With this arrangement, the luminous power during irradiation is almost constantly maintained and only the luminescence area varies, when the photoreceptor is exposed.

Accordingly, it is possible to prevent the deficiency that the density suddenly becomes high in tone property to the inputted image data, thereby realizing an excellent halftone reproduction.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description. The present invention will become more fully understood from the detailed description given hereinbelow and the accompanying drawings which are given by way of illustration only, are not in any way intended to limit the scope of the claims of the present invention.

Figure 14:
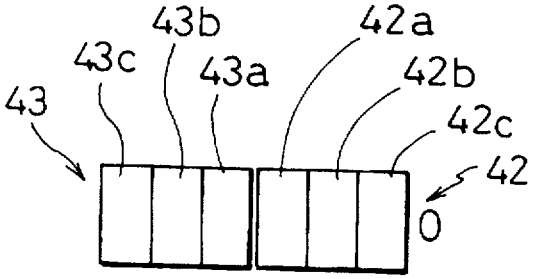
FIGS. 14(*a*) through 14(*g*) are plan views showing the luminescence states by the respective luminescence portions in the case where two LEDs make a pair, and FIG. 14(*a*)
Figure 14:
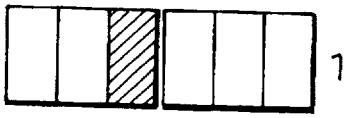
Figure 14:
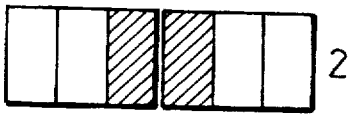
Figure 14:
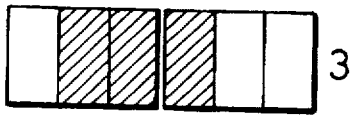
Figure 14:
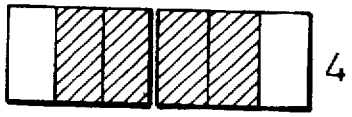
Figure 14:
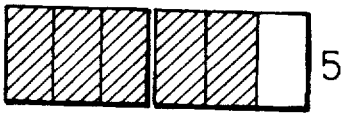
Figure 14:
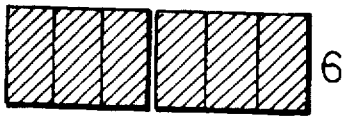
Figure 15A:
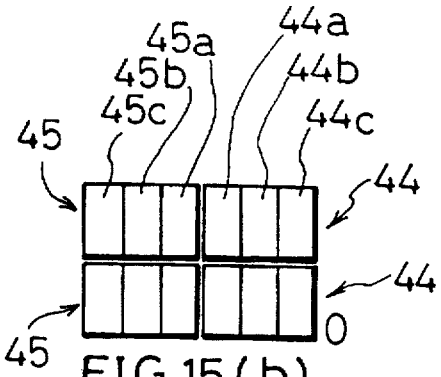
Figure 15B:
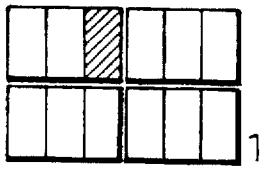
Figure 15C:
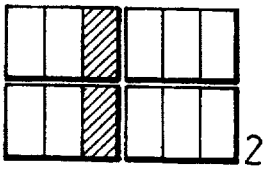
Figure 15D:
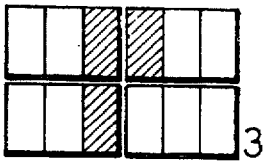
Figure 15E:
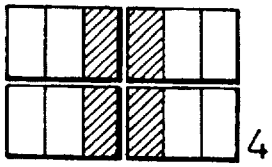
Figure 15F:
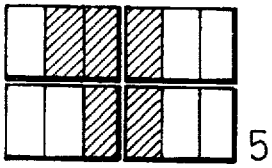
Figure 15G:
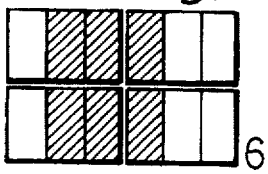
Figure 15H:
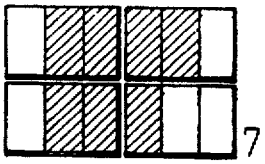
Figure 15I:
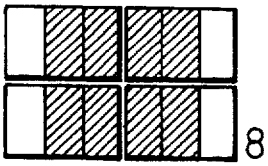
Figure 15J:
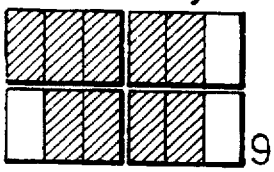
Figure 15K:
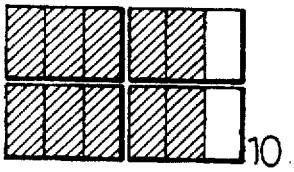
Figure 15L:
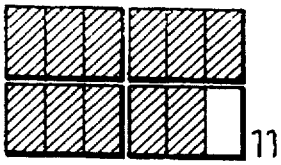
Figure 15M:
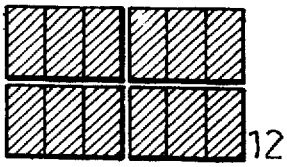

shows the luminescence state in which no luminescence portions emit light, FIG. 14(*b*) shows the luminescence state by a single luminescence portion, FIGS. 14(*c*), 14(*d*), 14(*e*), 14(*f*) and 14(*g*) show the luminescence states by two, three, four, five and six luminescence portions, respectively.

FIGS. 15(*a*) through 15(*m*) are plan views showing the luminescence states by the respective luminescence portions in the case where four LEDs make a set, and FIG. 15(*a*) shows the luminescence state in which no luminescence portions emit light, FIG. 15(*b*) shows the luminescence state by a single luminescence portion, FIGS. 15(*c*), 15(*d*), 15(*e*), 15(*f*), 15(*g*), 15(*h*), 15(*i*), 15(*j*), 15(*k*), 15(*l*) and 15(*m*) show the luminescence states by two, three, four, five, six, seven, eight, nine, ten, eleven and twelve luminescence portions, respectively.

Figure 16:
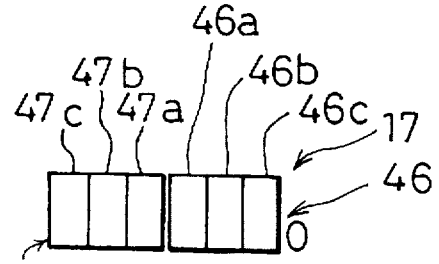
Figure 16:
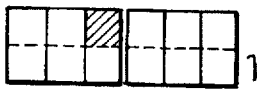
Figure 16:
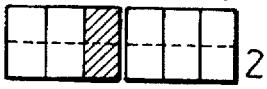
Figure 16:
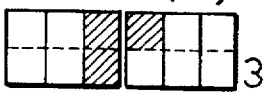
Figure 16:
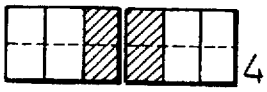
Figure 16:
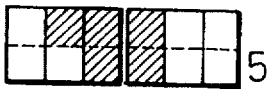
Figure 16:
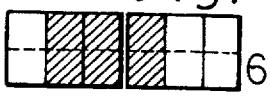
Figure 16:
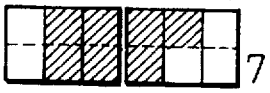
Figure 16:
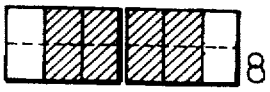
Figure 16:
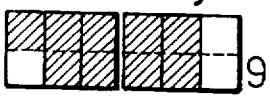
Figure 16:
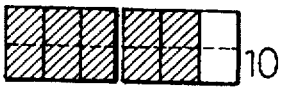
Figure 16:
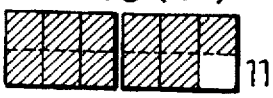
Figure 16:
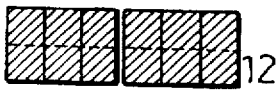

FIGS. 16(*a*) through 16(*m*) are plan views showing the luminescence states by the respective luminescence portions in the case where the dither technique and the pulse width control of the sub scanning direction are combined, and FIG. 16(*a*) shows the luminescence state in which no luminescence portions emit light, FIG. 16(*b*) shows the luminescence state by a single luminescence portion, FIGS. 16(*c*), 16(*d*), 16(*e*), 16(*f*), 16(*g*), 16(*h*), 16(*i*), 16(*j*), 16(*k*), 16(*l*) and 16(*m*) show the luminescence states by two, three, four, five, six, seven, eight, nine, ten, eleven and twelve luminescence portions, respectively.

Figures 17, 17B:
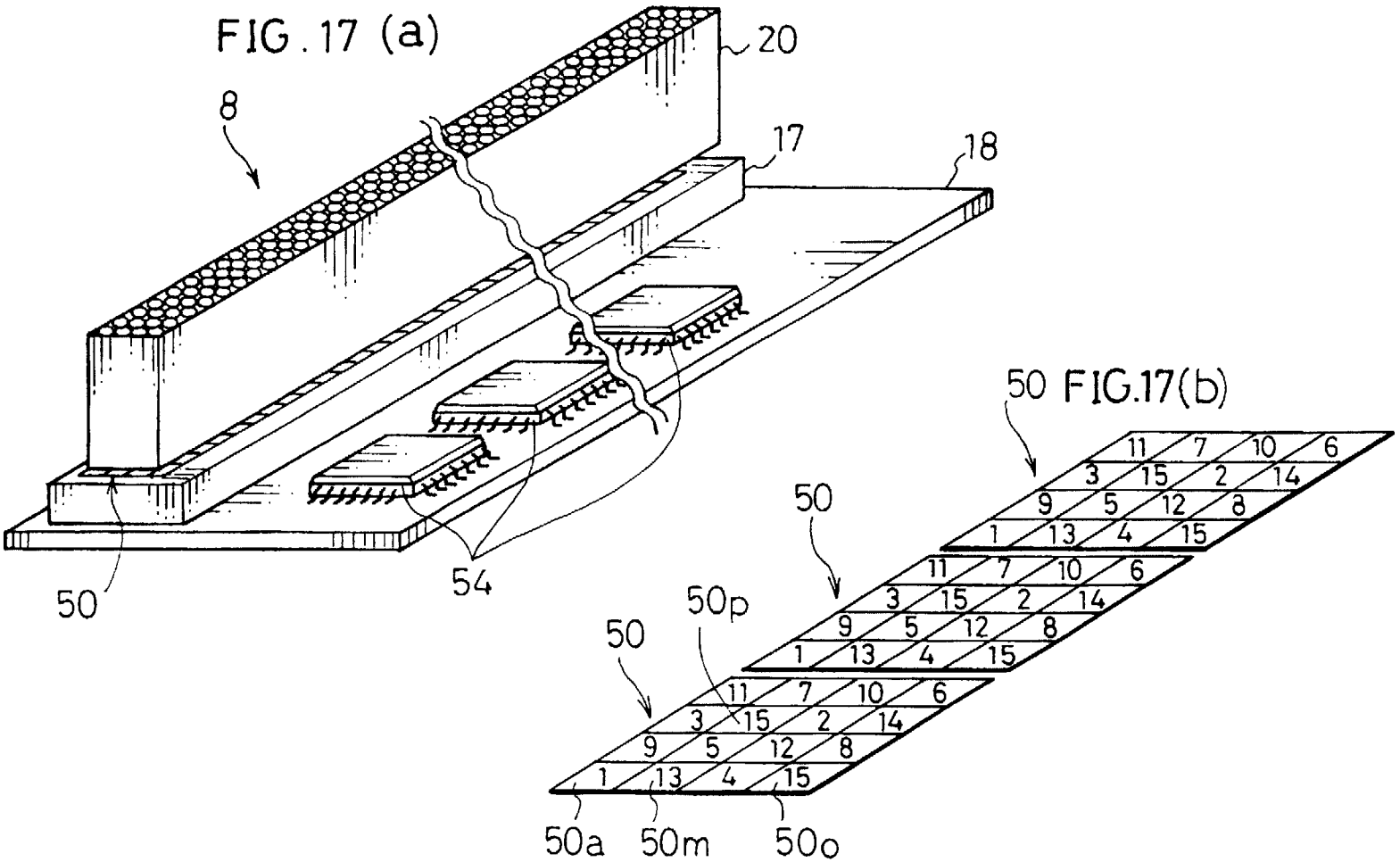

FIGS. 17(*a*) and 17(*b*) show the structure of another type of exposure means provided in a digital copying machine in accordance with another embodiment of the present invention, FIG. 17(*a*) is a perspective view showing the whole structure of the exposure means including an LED array, and FIG. 17(*b*) is a perspective view showing the structure of each LED.

Figure 18:
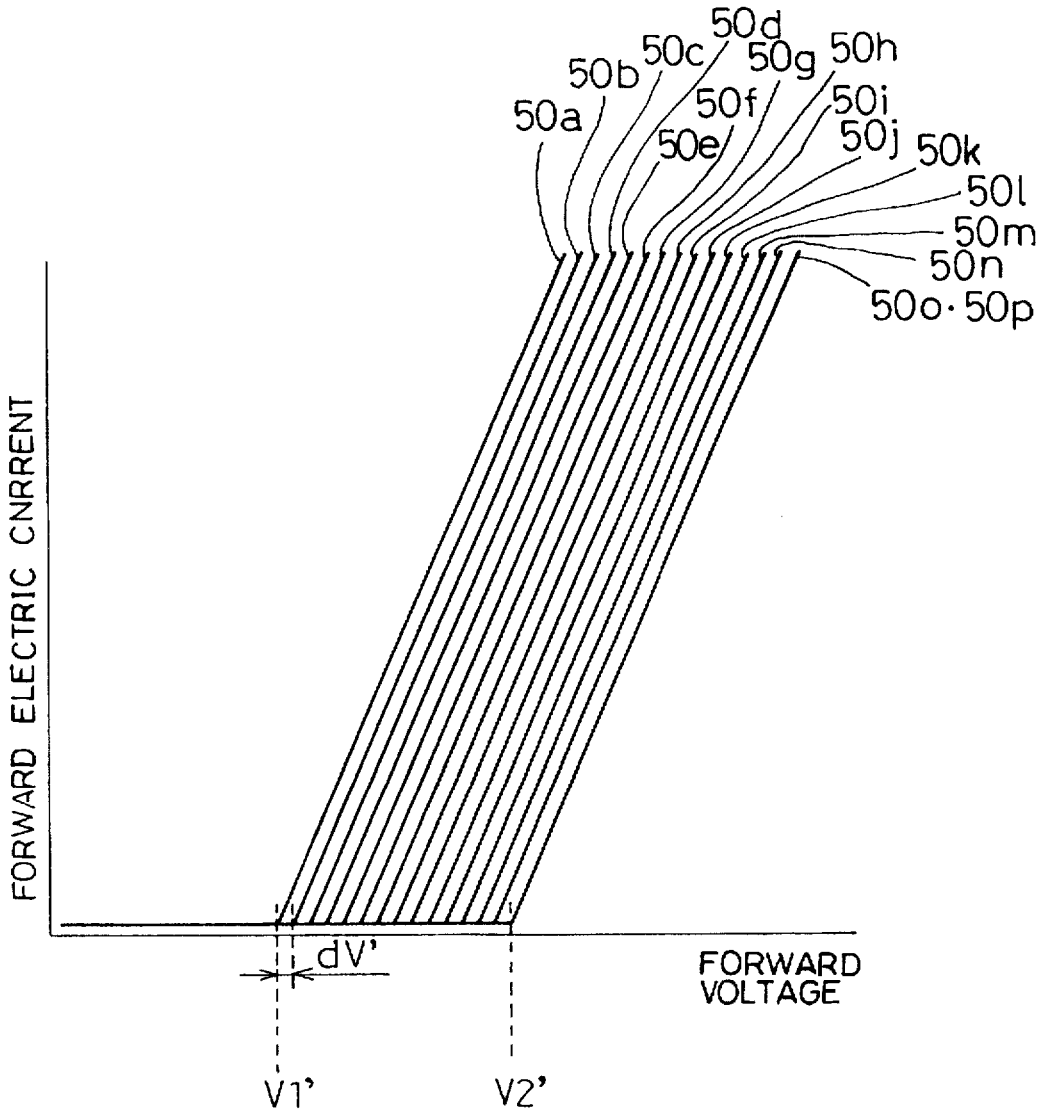

FIG. 18 is a graph showing the relation between the applied voltage (i.e., the forward voltage) and the electric current for the luminescence (i.e., the forward electric current), of the respective luminescence portions in the LED within the exposure means of FIG. 17(*a*).

Figure 19:
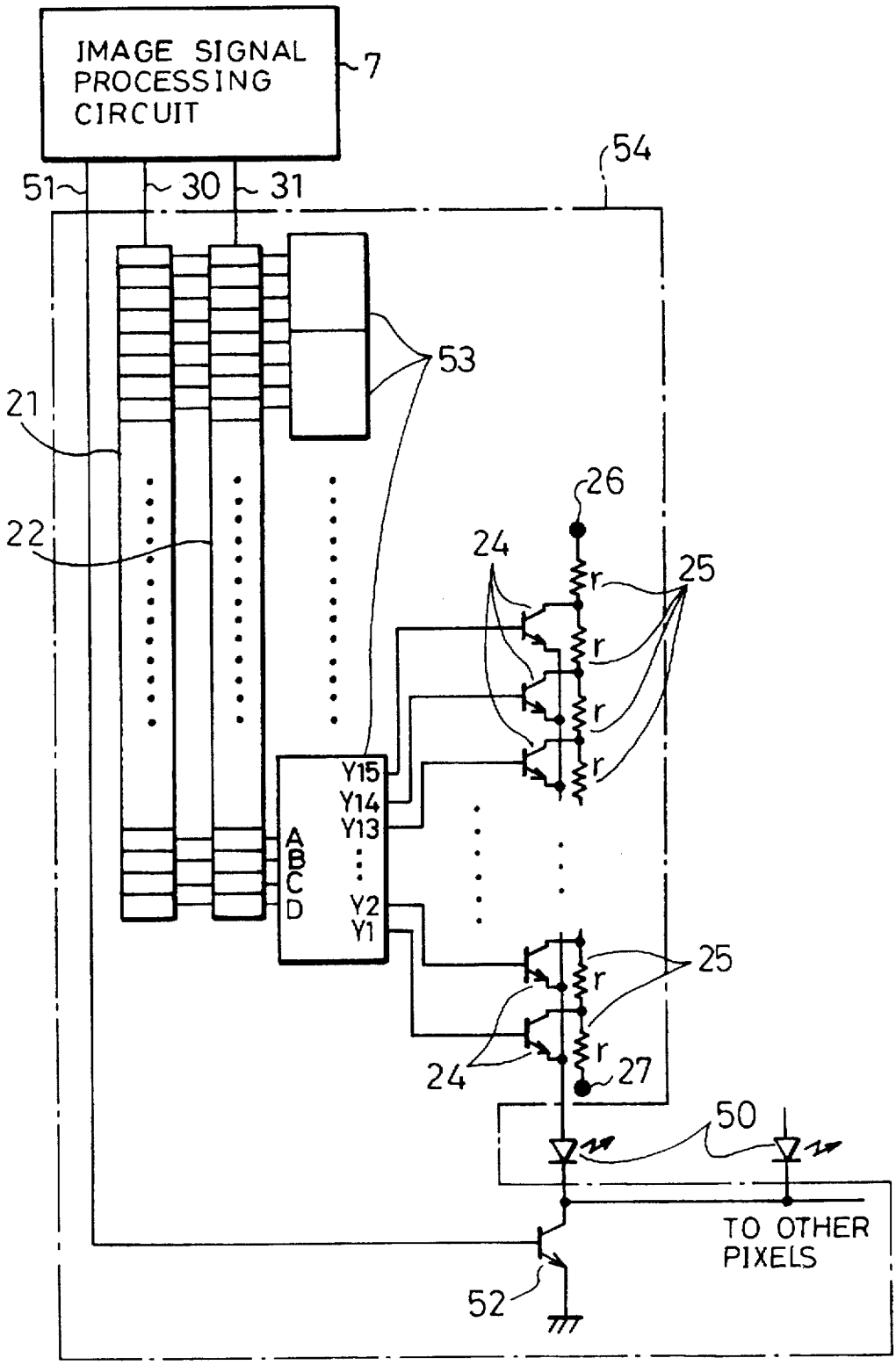

FIG. 19 is a block diagram showing the structure of a driver IC provided in the exposure means of FIG. 17(*a*).

Figure 20:
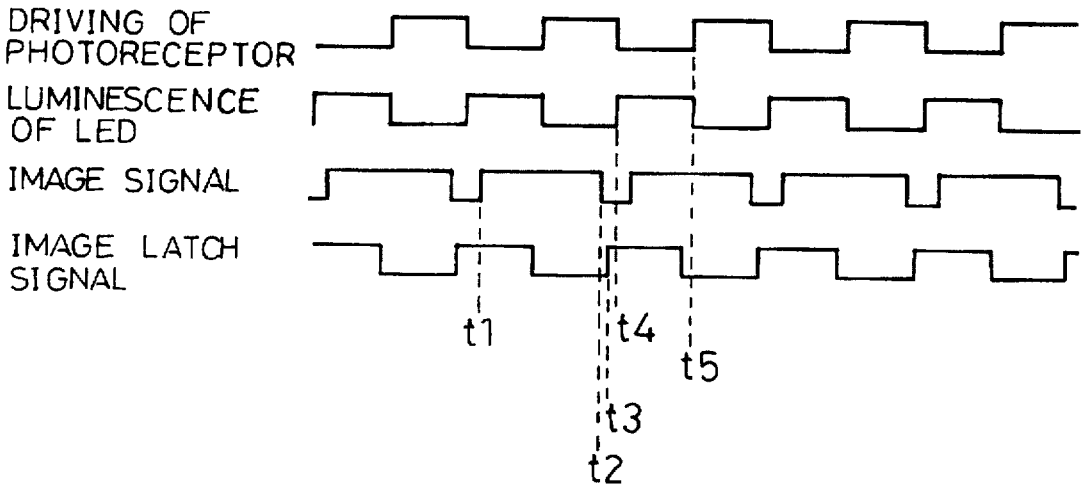

FIG. 20 is a timing chart showing an operation in the case where the photoreceptor is driven in the stepped manner and tone expression is realized by increasing the luminescence area in the sub scanning direction.

Figure 21:
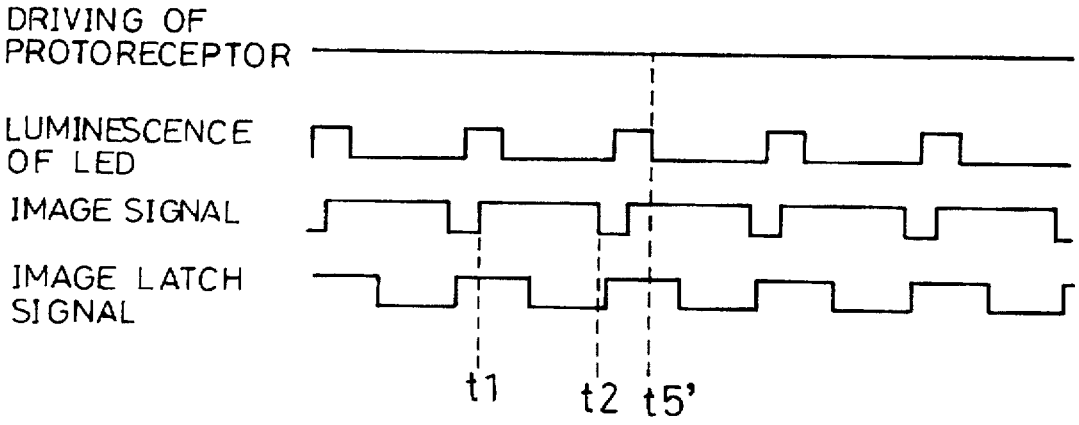

FIG. 21 is a timing chart showing an operation in the case where the photoreceptor rotates constantly and tone expression is realized by increasing the luminescence area in the sub scanning direction, in accordance with a still another embodiment of the present invention.

DESCRIPTION OF THE EMBODIMENTS

The following description deals with a first embodiment of the present invention with reference to FIGS. 1 through 8.

Figure 2:
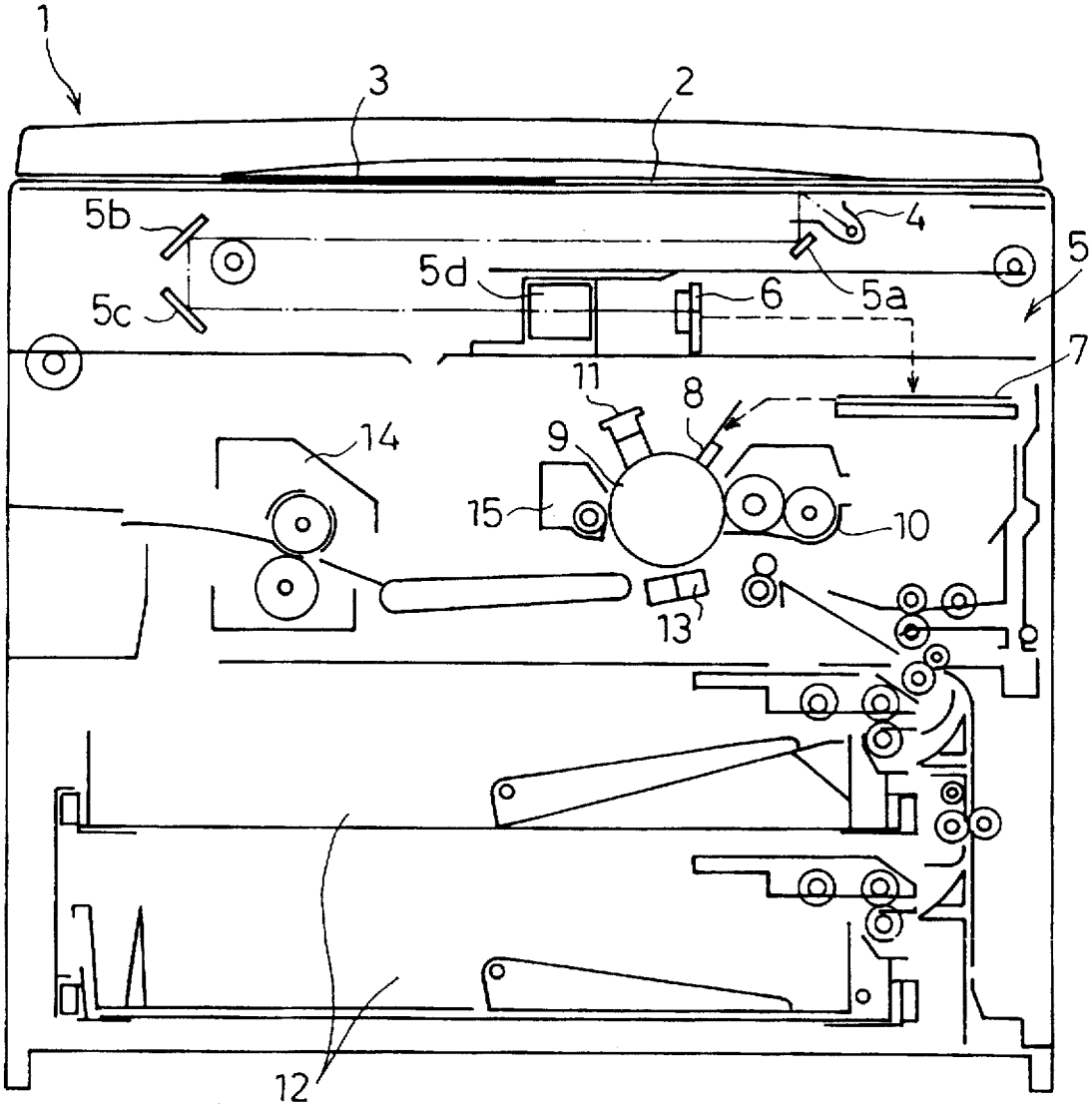
FIG. 2 is a schematic explanatory diagram showing the whole structure of the digital copying machine.

An image forming apparatus of the present embodiment is a digital copying machine 1, as depicted in FIG. 2. The digital copying machine 1 is provided with a document plate 2, in the upper end portion thereof, which is made of hard transparent glass. There is provided a reading section 5 under the document plate 2. The reading section 5 includes a CCD (Charge Coupled Device) sensor 6 and a halogen lamp 4 for irradiating a document 3 placed on the document plate 2. When light is projected onto the document 3 by the halogen lamp 4, its reflected light is guided to the CCD sensor 6 through mirrors 5*a*, 5*b* and 5*c*, and a focus lens 5*d*, and the optical image of the document 3 is focused on the CCD sensor 6.

The CCD sensor 6 is composed of sensors for five thousands of pixels and can read an A3-size document by the resolution of 400 dots per inch (dpi).

There is provided an image signal processing circuit 7 under the reading section 5. Signals of the image data outputted from the CCD sensor 6 are converted into digital signals by Analog/Digital conversion, and processed by the image signal processing circuit 7. Then, the digital signals are inputted to an exposure device 8. The exposure device 8 has light emitting diodes (i.e., LEDs) as light emitting devices. More specifically, as shown in FIG. 1(*a*), the exposure device 8 is provided with an LED array 17 in which LEDs 16 emit light according to the digital signals of the image data.

Referring again to FIG. 2, the digital copying machine 1 also includes a photoreceptor 9. When the photoreceptor 9, charged beforehand by a charger 11, is exposed to light emitted by the LEDs 16, an electrostatic latent image is formed on the photoreceptor 9. The electrostatic latent image becomes a toner image by toners supplied by a developer 10 provided on the downstream side of the exposure position. The toner image is transferred by a transfer unit 13 to a sheet of paper supplied by a paper cassette 12 and the transferred image is fused by a fuser 14. Residual toners on the photoreceptor 9 are removed out by a cleaner 15.

The following description describes the exposure device 8 of the digital copying machine 1 in more detail.

Figure 1:
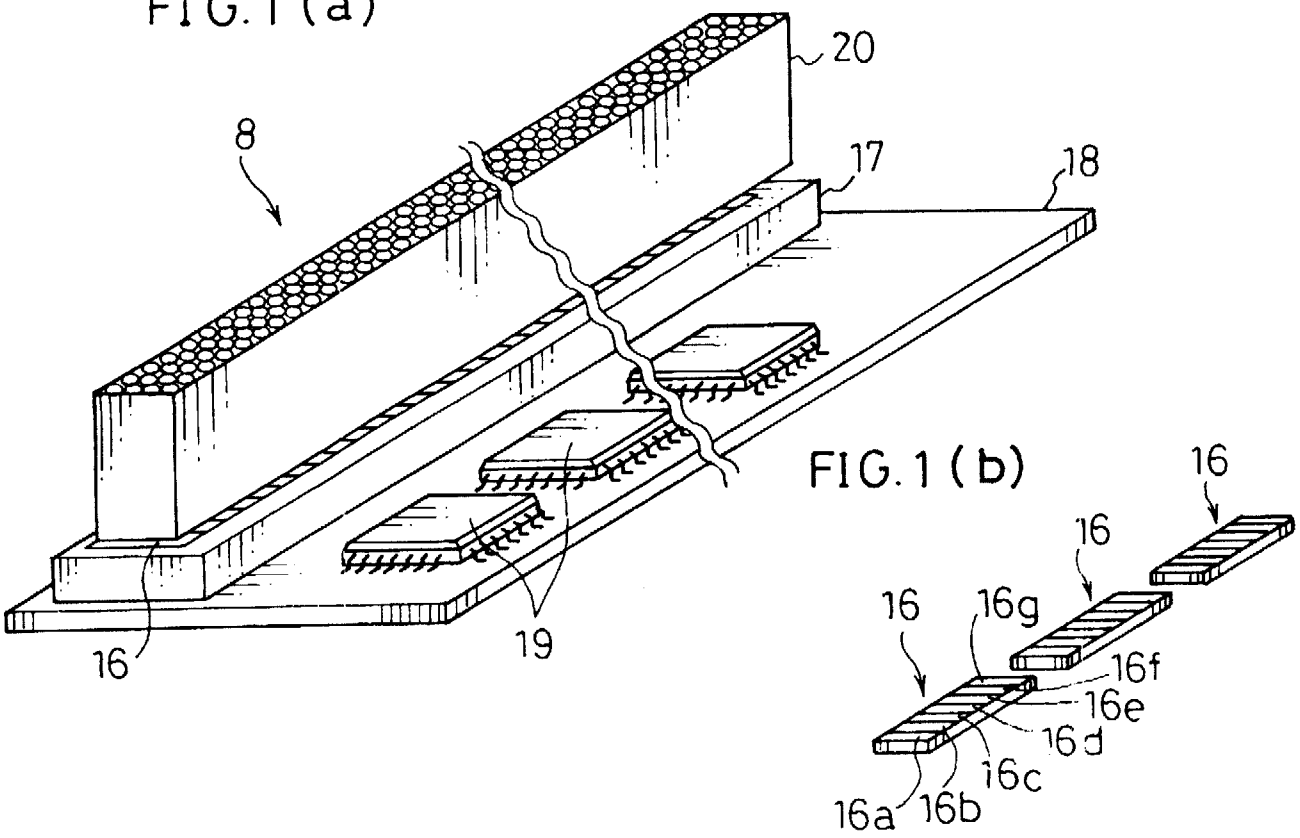
FIGS. 1(*a*) and 1(*b*) show the structure of an exposure means provided in a digital copying machine in accordance with one embodiment of the present invention, FIG. 1(*a*) is a perspective view showing the whole structure of the exposure means including an LED array, and FIG. 1(*b*) is a perspective view showing the structure of each LED.

As shown in FIG. 1(*a*), the exposure device 8 is composed of the LED array 17, a substrate 18, driver integrated circuits (i.e., driver ICs) 19 and a SELFOC lens array 20. The LED array 17 includes five thousand LEDs 16 which are aligned along the main scanning direction (i.e., the longitudinal direction) of the photoreceptor 9 and which have the same resolution of 400 dpi as the CCD sensor 6. The substrate 18 fixes the LED array 17 and the driver ICs 19 thereon. The driver IC 19 drives the LEDs 16 as a light emitting device driver. The SELFOC lens array 20 is provided on the light emitting side of the LED array 17. Light emitted by the LEDs 16 is focused on the photoreceptor 9 through the SELFOC lens array 20.

Figure 3B:
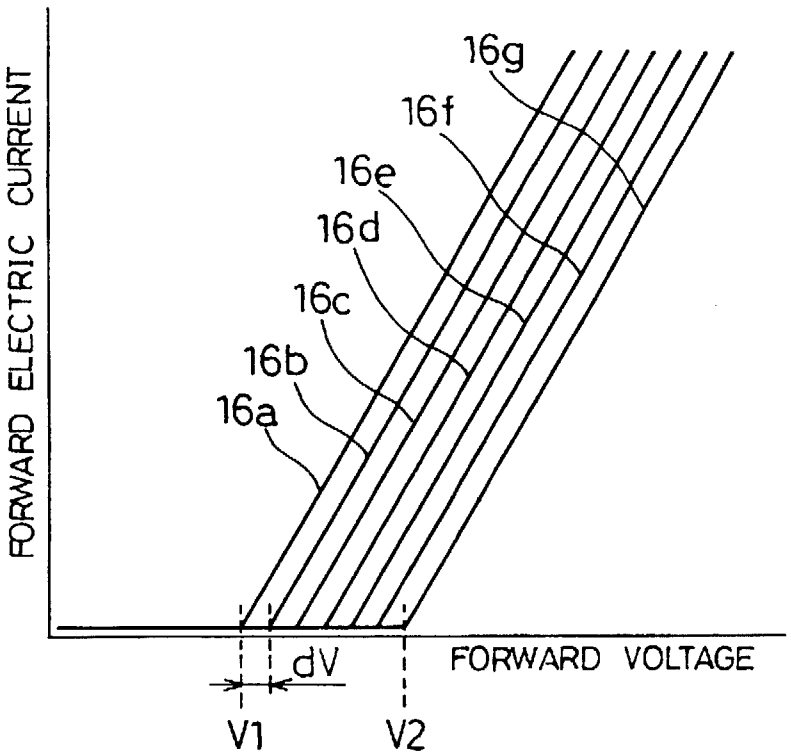
FIGS. 3(*a*) and 3(*b*) are graphs showing the voltage dependency of the LED, FIG. 3(*a*) is a graph showing the relation between the voltage applied to the LED and the luminous power, and FIG. 3(*b*) is a graph showing the relation between the applied voltage (i.e., the forward voltage) and the electric current for the luminescence (i.e. the forward electric current), among the first luminescence portion through the seventh luminescence portion in the LED.
Figure 3:
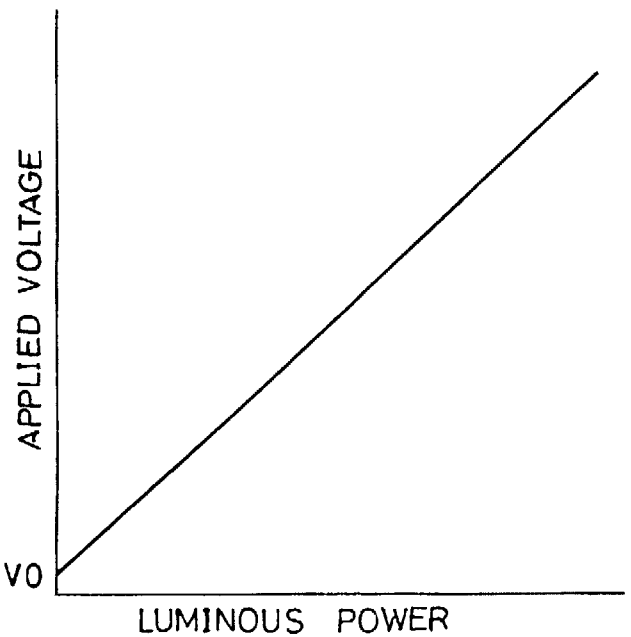

As shown in FIG. 1(*b*), each of the LEDs 16 is composed of seven luminescence portions, i.e., the first luminescence portion 16*a* through the seventh luminescence portion 16*g*, which differ from each other in their luminescence starting voltages. Referring to FIG. 3(*a*), if a voltage applied to the respective LEDs 16 is below a predetermined voltage V0, the LEDs 16 do not emit light because little electric current flows through the LEDs 16. Each of the LEDs 16, however, start to emit light by the electric current therethrough, if the applied voltage exceeds V0. The respective LEDs 16 are manufactured so as to be made of seven areas which gradually differ from each other in components of material. Namely, the seven areas are formed so as to have different luminescence starting voltages; each of the seven areas differs from its adjacent area in the luminescence starting voltage by a dV [V], as shown in FIG. 3(*b*).

Figure 4:
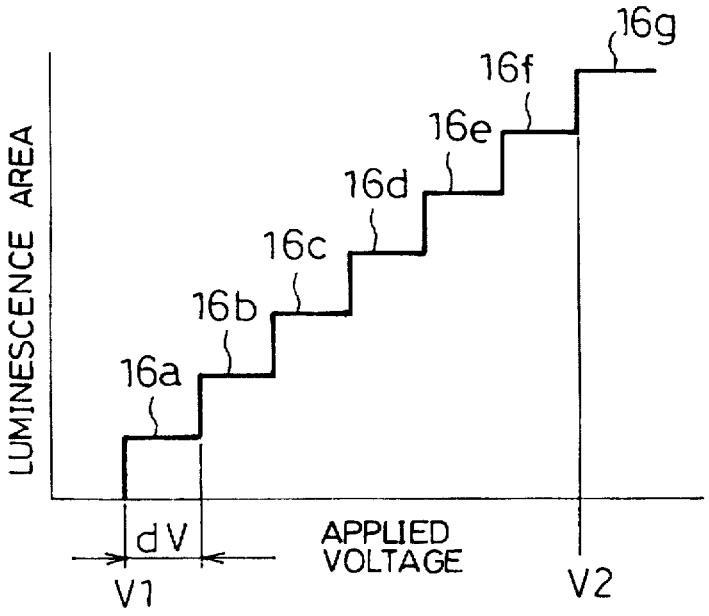
FIG. 4 is an explanatory diagram showing the state that the luminescence area increases step by step, by the respective luminescence portions of the LED.

Referring to FIG. 3(*b*), the first luminescence portion 16*a*, which emits light in response to the lowest voltage of all the luminescence portions 16*a* through 16*g*, starts to emit light when a voltage V1 [V] is applied to the LED 16. The second luminescence portion 16*b* starts to emit light, if the applied voltage increases to become (V1+dV) [V]. Thus, whenever the voltage applied to the LED 16 increases by the dV [V], another luminescence portion starts to emit light. This results in that the luminescence area of the LED 16 increases step by step, as shown in FIG. 4. Finally, the seventh luminescence portion 16*g* emits light when the applied voltage is V2 [V] or more. In this case, the whole area of the LED 16, which corresponds to a single light emitting device in a single pixel, emits light and the LED 16 has the maximum luminescence area.

Figure 5:
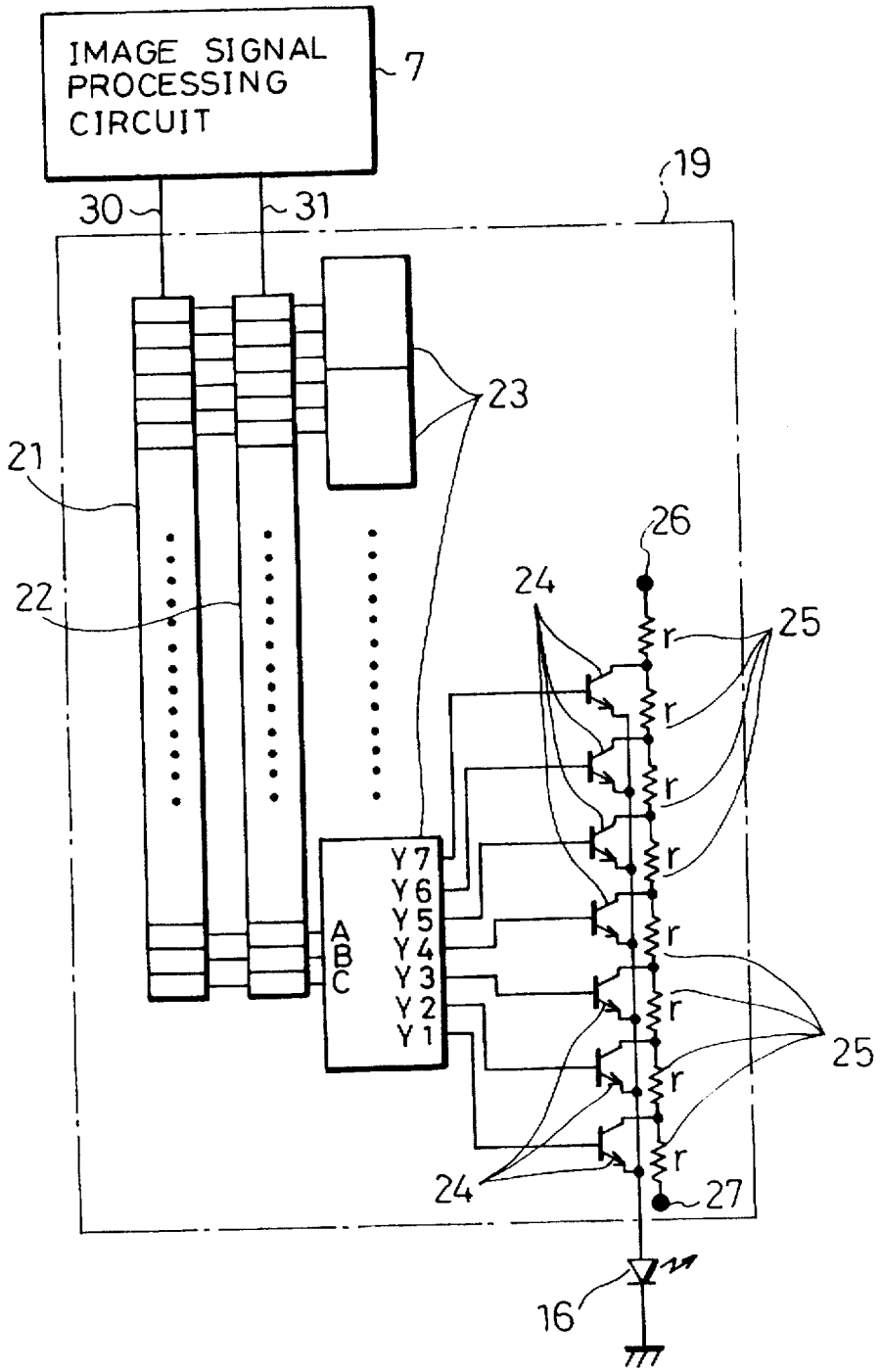
FIG. 5 is a block diagram showing a driver IC provided in the exposure means.

The driver IC 19 controls the voltages applied to the respective LEDs 16. The driver IC 19 is composed of a shift register 21, a latch circuit 22, decoders 23, transistors 24 and resistors 25, as shown in FIG. 5.

The image data, dispatched from the image signal processing circuit 7 to the driver IC 19, are three binary bits of digital values and can express eight degrees of density, including "white" density, in a single pixel. The image data are outputted from the image signal processing circuit 7 and are successively inputted to the shift register 21 in the order of firstly the MSB (Most Significant Bit) through an image signal line 30 along with clocks for synchronization (not shown). The shift register 21 is made of;

[the number of LEDs]×[the number of bits of image data in a single pixel]

i.e., fifteen thousands (5000×3) of bits which are connected in series. Serial image data outputted from the image signal processing circuit 7 are successively shift-inputted to the shift register 21, while each bit of the shift register 21 outputs to each bit of the latch circuit 22 which is connected therewith in parallel.

A latch signal 31 is switched from "0" to "1", when the image signal processing circuit 7 has supplied the image data of a single line to the shift register 21. The latch circuit 22 latches the output of the shift register 21 in synchronization with the rising of the latch signal 31 from "0" to "1".

Every three bits of the latch circuit 22 are connected with a single decoder 23. Namely, there are provided five thousand decoders 23 in accordance with the number of the LEDs 16. Each of the decoders 23 has seven outputs, Y1 through Y7, and switches the output of "Yn" to "1", according to a numeral value "n" (n=0,1,2,3,4, 5,6 or 7) of inputted three bits. For example, when n=3, the decoder 23 switches the output of Y3 to "1". Furthermore, when n=0, all the outputs, Y1 through Y7, become "0". The numeral value "n" is zero when the image data corresponding to "white" are inputted, while the numeral value "n" is seven when the image data corresponding to "black" are inputted.

The seven outputs, Y1 through Y7, of each decoder 23 are respectively connected with a base terminal of the respective seven transistors 24.

The driver IC 19 also has the first standard voltage terminal 26 and the second standard voltage terminal 27 so as to receive the voltage for driving the LED 16. Between the first standard voltage terminal 26 and the second standard voltage terminal 27, there are eight resistors 25 which have the same resistance of "r" and which are connected in series. The first standard voltage terminal 26 and the second standard voltage terminal 27 are commonly used for five thousand sets of resistor networks.

Each collector of the transistors 24 is connected with each resistor 25 through each connecting point. Each emitter of the transistors 24 is connected with each anode of the LEDs 16. Each cathode of the LEDs 16 is grounded.

The seven transistors 24 and the eight resistors 25 are provided for a single pixel. In fact, there are provided transistors and resistors for five thousand pixels, which have the same arrangement as the transistors 24 and the resistors 25, and which are all connected with the respective decoders 23 and the respective LEDs 16.

With the arrangement, the driver IC 19 controls luminescence of the LEDs 16 as follows.

First, the image data of a single line are serially shift-inputted from the image signal processing circuit 7 to the shift register 21. Next, these image data are latched by the latch circuit 22 in synchronization with the latch signals 31. The decoder 23 decodes the image data with respect to every three bits of the latch circuit 22, i.e., every pixel. If the numeral value "n" of the image data is one of 1 to 7, the decoder 23 switches the corresponding output, one of Y1 to Y7, to "1" while the other outputs to "0". If the numeral value "n" of the image data is zero, the decoder 23 switches all the outputs Y1 through Y7 to "0". There occurs an "ON" condition between the collector and the emitter in the transistor 24 which is connected with the output of "1", and the voltage divided in accordance with the resistors 25 is applied to the LED 16.

Now suppose that the voltage applied to the first standard voltage terminal 26 is;

V2+1.5 dV [V]

and the voltage applied to the second standard voltage terminal 27 is;

V1−0.5 dV [V].

In this case, the voltage applied to the LED 16 is;

V1+(n−0.5)dV [V] ("n" is the numeral value of the image data).

Compare the applied voltage described above, with the respective luminescence starting voltages of all the luminescence portions, 16*a* through 16*g*, shown in FIG. 3(*b*). When n=1, the voltage applied to the LED 16 is between the first luminescence portion 16*a* and the second luminescence portion 16*b*. When n=2, the applied voltage is between the second luminescence portion 16*b* and the third luminescence portion 16*c*. Namely, how many luminescence portions emit light among the luminescence portions 16*a* through 16*g*, depends on the numeral value "n". For example, if the numeral value "n" is seven (n=7) corresponding to the image data of "black", all the luminescence portions 16*a* through 16*g* of the LED 16 emit light by the electric current therethrough. If the numeral value "n" is zero (n=0) corresponding to the image data of "white", all the transistors 24 shown in FIG. 5 are switched off and no luminescence portions of the LED 16 emit light because little electric current flows through the LED 16.

In the digital copying machine 1, the photoreceptor 9 has a high gamma "γ" characteristic. As a result, dot pattern formation by the toners on the photoreceptor 9 depends on only whether luminescence of the LEDs 16 exists, not intensity of the luminous power. In other words, even if unevenness of brightness occurs among the LEDs 16, it is possible to realize an excellent tone expression by the precise area control technique with which the luminescence area increases step by step, because of the use of the photoreceptor 9 having the high gamma "γ" characteristic.

As described above, the driver IC 19 applies the voltage to the respective luminescence portions 16*a* through 16*g*, so that the luminescence area increases step by step based on the image data. In other words, the image data is controlled so as to increase the luminescence area step by step through the luminescence portions 16*a* through 16*g*, and the electrostatic latent image is formed on the photoreceptor 9 by the exposure operation. Accordingly, it is possible to realize a precise and accurate tone reproduction.

Moreover, it is possible, without any specific filters, to precisely and easily change a dot-size of a single pixel of the electrostatic latent image formed on the photoreceptor 9 by the use of only the LEDs 16, because the luminescence area increases step by step. This makes possible precise tone expression without causing any reduction of the resolution.

In increasing the luminescence area step by step, the driver IC 19 applies the voltage to the respective luminescence portions 16*a* through 16*g* so that the luminescence area increases step by step each time a voltage of more than the predetermined voltage is added. As a result, it is possible to control the luminescence area of the respective LEDs 16 with ease.

Accordingly, it is possible to form the electrostatic latent image having many tones on the photoreceptor 9 based on the image data accurately, precisely and easily.

In the digital copying machine 1 in accordance with the present embodiment, each LED 16 increases its luminescence area step by step each time a voltage of more than the predetermined voltage is added. If the voltage level of the applied voltage is simply divided between zero [V] and the maximum driving voltage, all the image data assigned to below the luminescence starting voltage V1 (see FIG. 3(*b*)) become "white". In the digital copying machine 1, however, all the image data are assigned to the voltage level beyond the luminescence starting voltage V1, except the image data of "white". Therefore, it is possible to avoid such a deficiency.

The present invention is not limited to the present embodiment, but can be modified in various ways within the scope of the invention. For example, in the arrangement of the present embodiment, the image signals transmitted from the image signal processing circuit 7 to the exposure device 8 are three binary bits, and the luminescence area of the LED 16 changes each time the image data change. However, the present invention is not limited to this arrangement.

In general, the image data from the CCD sensor 6 are inputted to the image signal processing circuit 7 by not less than eight bits of tones. Therefore, it is within the scope of the invention to measure beforehand the density change of the real toner image compared with the change of the luminescence area of the LED 16, and to convert not less than three bits of image data into three bits of LED driving data in the image signal processing circuit 7 so as to improve image quality.

Moreover, in the digital copying machine, the respective luminescence portions 16*a* through 16*g* of the LED 16 are arranged so as to emit light in this order along the main scanning direction. However, such a modification may be made that the luminescence portions of the LED emit light in due order along the sub scanning direction.

Figure 6:
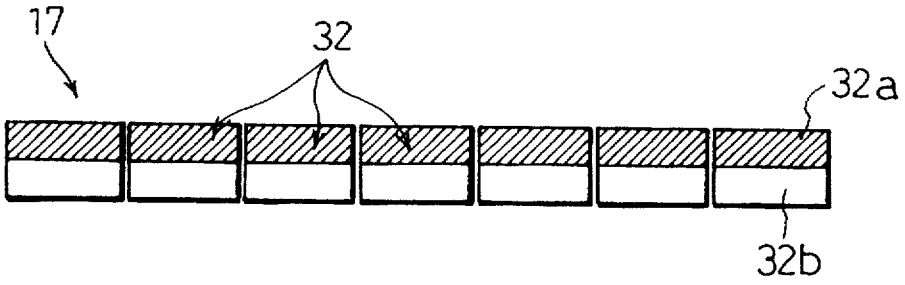
FIG. 6 is a plan view showing another type of LED in which the luminescence area of luminescence portions increases by two-stages in the sub scanning direction.

For example, as shown in FIG. 6, the LED array 17 can be arranged so that the luminescence area of the LED array 17 increases by two-stages along the sub scanning direction (i.e., the longitudinal direction of FIG. 6).

Each of the LEDs 32 has the first luminescence portion 32*a* and the second luminescence portion 32*b*. The second luminescence portions 32*b* are aligned in the sub scanning direction as seen from the first luminescence portions 32*a*. Each LED 32 has two luminescence patterns selected by the applied voltage. In one luminescence pattern, only the first luminescence portion 32*a* emits light, and in the other luminescence pattern, both the first and the second luminescence portions, 32*a* and 32*b*, emit light.

The luminescence pattern can be optionally set in a control section (not shown) by a record mode selection (whether it is twice of normal resolution or not) of the resolution of the sub scanning direction. In the normal resolution, light is emitted from the whole area of the LED 32, i.e., both the first and the second luminescence portions 32*a* and 32*b*. When the resolution is twice of the normal resolution, only the first luminescence portion 32*a* emits light. Moreover, luminescence time and luminescence interval (or timing) of the two luminescence portions 32*a* and 32*b* are controlled so as to form the electrostatic latent image on the photoreceptor 9.

In the case where only the first luminescence portion 32*a* emits light, i.e., in the case where the resolution is twice of the normal resolution, the luminescence interval is a half of that in the case of the normal resolution. In other words, in the case where the resolution is twice of the normal resolution, the timing is twice faster than that in the case of the normal resolution.

Half-tone recording and high resolution recording, which take advantage of the change of luminescence area through the two luminescence portions 32*a* and 32*b*, can be precisely realized by the use of the photoreceptor 9. The photoreceptor 9 has the high gamma "γ" characteristic wherein its surface electric potential suddenly lowers on the border of a specific luminous power.

As described above, it is possible to increase the luminescence area not only in the main scanning direction but also in the sub scanning direction. When the LED 32 is arranged so as to increase its luminescence area step by step in the sub scanning direction, the shape of each dot formed on the photoreceptor 9 can be changed step by step in the sub scanning direction by changing (or controlling) the voltage applied to the LED 32. Therefore, in the case of improving the resolution of the sub scanning direction, it is possible to narrow a control range of the luminescence time of the LED 32 by means of diminishing its luminescence area, i.e., the shape in the sub scanning direction. Accordingly, it is possible to realize a more detailed tone expression and a compact arrangement of the driver IC 19.

Alternatively, there may be provided a filter, between the LED 16 and the photoreceptor 9, having the characteristics by which its transmission ratio decreases in accordance with a change of a luminescence wavelength due to an increase in the luminous power of the LED 16.

Figure 7:
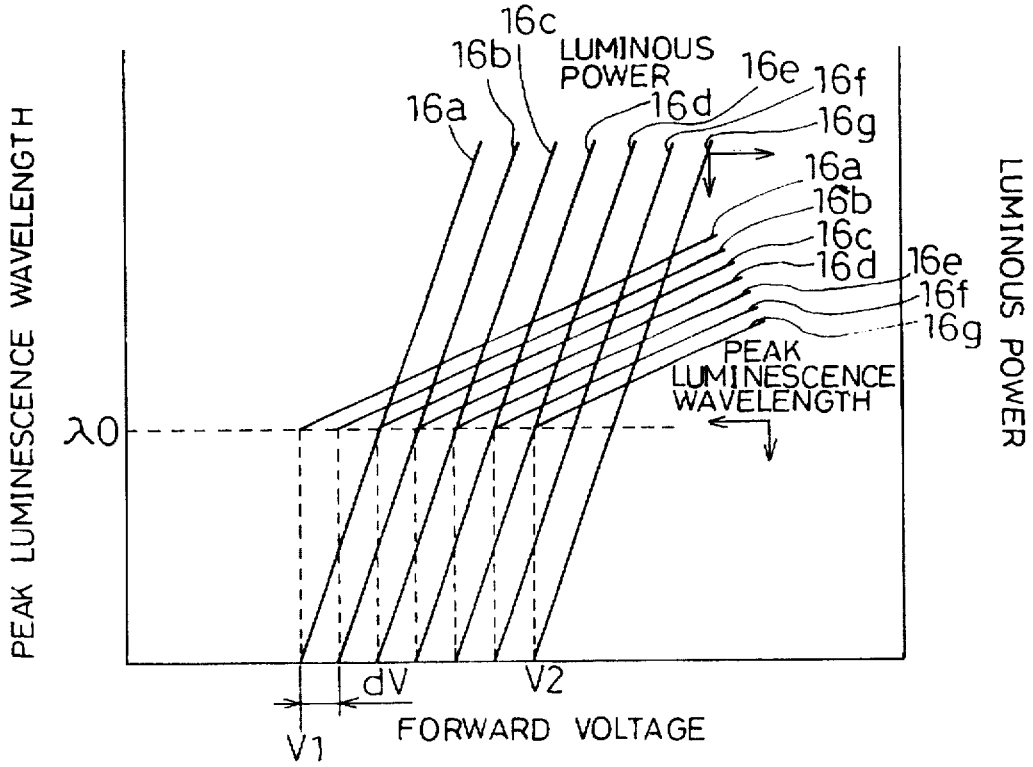
FIG. 7 is a graph showing the relation among the forward voltage, the luminous power, and the peak luminescence wavelength, in the respective luminescence portions.

As shown in FIG. 7, in the respective luminescence portions 16*a* through 16*g*, peak luminescence wavelengths at the luminescence starting time are represented by the wavelength "γ0", which is common to all the luminescence portions 16*a* through 16*g*. However, the peak luminescence wavelengths have a tendency to shift to the longer wavelength side in accordance with a monotonous increase in the luminous power due to an increase in the forward voltage.

Therefore, it is preferable to provide the filter so as to surpress the increase in the luminous power due to the increase in the forward voltage to the LED 16, taking advantage of the shift of the peak luminescence wavelengths to the longer wavelength side.

Figure 8:
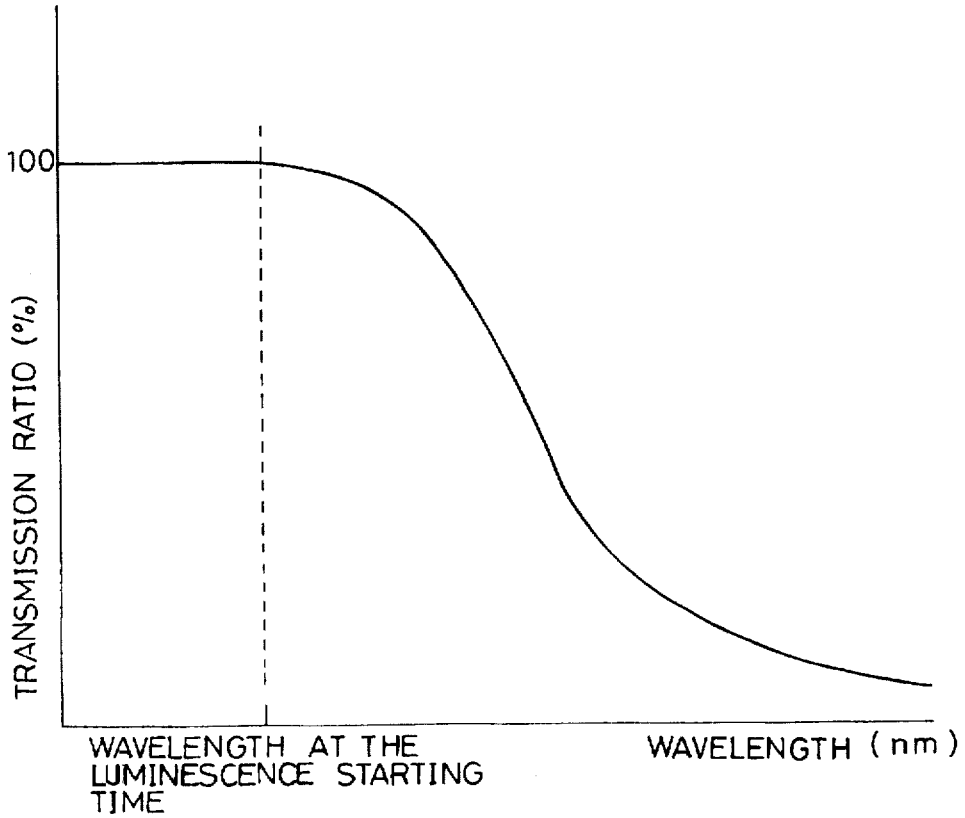
FIG. 8 is a graph showing the optical property of a filter provided between the LED and a photoreceptor.

The filter has the characteristics by which its transmission ratio decreases as the wavelength is higher, as shown in FIG. 8.

By providing the filter between the LED 16 and the photoreceptor 9, exposure amount toward the photoreceptor 9 by the respective luminescence portions 16*a* through 16*g* of the LED 16 becomes substantially the same level. Therefore, the exposure amount toward a minute portion of the photoreceptor 9 remains specific while only the exposure area increases, even if the forward voltage in the LED 16 increases.

As a result, it is possible to prevent an undesirable density change and to realize a tone reproduction by means of the tone expression due to the simple area control. Namely, in the tone property with regard to the inputted image data, it is possible to prevent an undesirable sudden increase in the density and to realize an excellent half tone reproduction.

Figure 9:
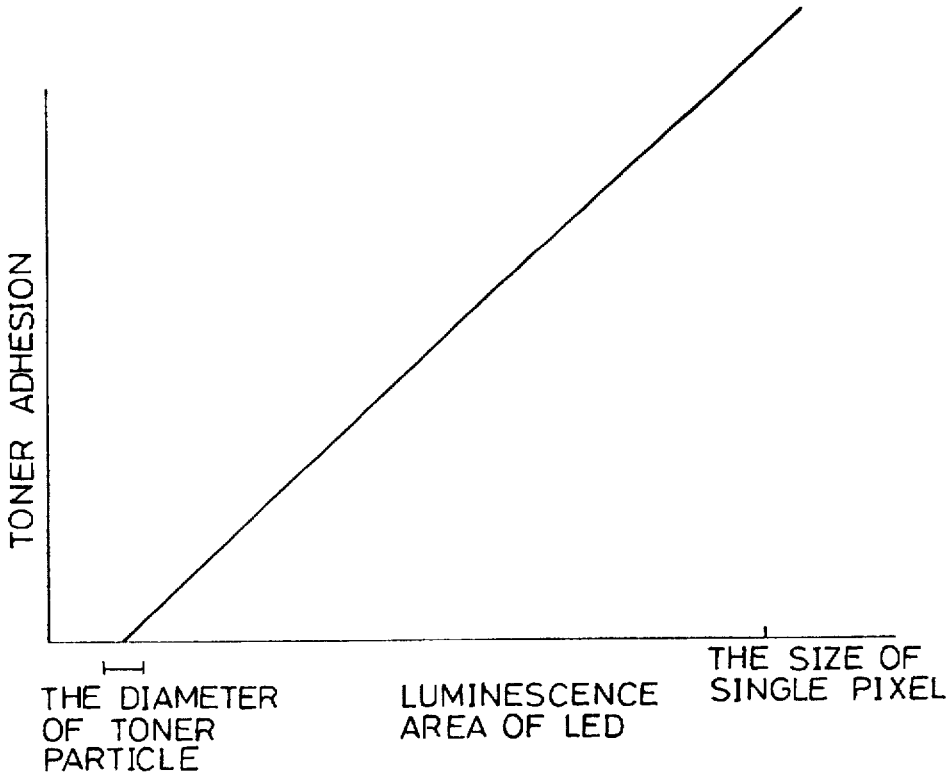
FIG. 9 is a graph showing the relation between the luminescence area of the LED and the toner adhesion, in accordance with another embodiment of the present invention.
Figure 10:
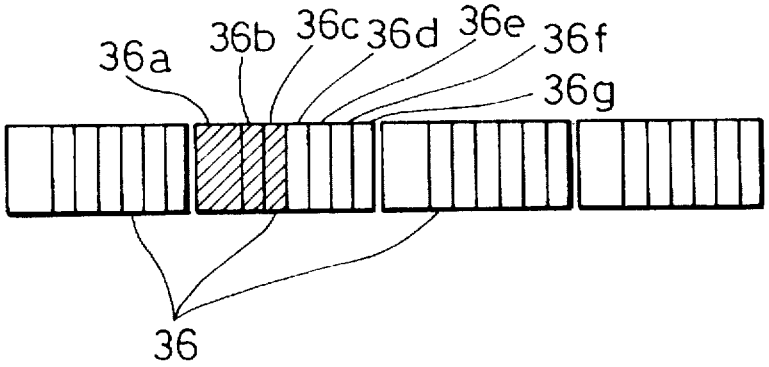
FIG. 10 is a plan view showing a still another type of LED in which the first luminescence portion is greater than the other luminescence portions of the LED.

The following description deals with a second embodiment of the present invention with reference to FIGS. 9 and 10. For convenience, the member which has the same function as that of the foregoing first embodiment is denoted as the same reference numeral, and the detailed explanations thereof are omitted.

As shown in FIG. 9, there is rarely toner adhesion to the photoreceptor 9, if the exposure area onto the photoreceptor 9 is substantially the same as, or smaller than, the diameter of the toner particle. Namely, if the minimum luminescence area of the LED is substantially the same as, or smaller than, the diameter of the toner particle, there is rarely toner adhesion to the photoreceptor 9 with respect to the projection by the luminescence area.

The copying machine of the present embodiment, however, is provided with LEDs 36 of which the first luminescence portion 36*a*, corresponding to the minimum luminescence area, is not less than the other luminescence portions 36*b* through 36*g*, as shown in FIG. 10. The area of the first luminescence portion 36*a* is substantially the same size as, or greater than, the diameter of the toner particle. The areas of the other luminescence portions 36*b* through 36*g* are all the same size.

The size of a single pixel is 63.5 μm square in the exposure device 8 having the 400 dpi of resolution. If a single pixel is divided into many portions, for example, equivalent thirty-one portions, a single portion is approximately 2 μm wide, which is smaller than the diameter of the toner particle. In this case, no toner adheres to the area of four or five portions from the beginning of the luminescence, the four or five portions not contributing to the image formation.

In order to avoid the above problem, it is preferable to set the first luminescence portion of the LED to the same size as the diameter of the toner particle, and to divide the residual area into equivalent thirty areas.

In the copying machine of the present embodiment, as described above, the first luminescence portion 36*a* is arranged so that its size is substantially the same size as, or greater than, the diameter of the toner particle. With the arrangement, even when only the first luminescence portion 36*a* emits light, its light is certainly irradiated onto the photoreceptor 9 so that the toner can adhere to the photoreceptor 9.

Furthermore, the total size of the three luminescence portions 36*a*, 36*b* and 36*c* (i.e., the slash area of FIG. 10) is the same as the total size of the four luminescence portions 36*d*, 36*e*, 36*f* and 36*g*. Namely, the total size of the three luminescence portions 36*a*, 36*b* and 36*c* is just a half of the maximum luminescence area of the LED 36. Additionally, the total shape of the three luminescence portions 36*a*, 36*b* and 36*c* is a rectangle whose width is slightly longer, and the ratio of length and width of the total area including all the luminescence portions 36*a* through 36*g* is approximately 1:2. Namely, the length of the LED 36 in the sub scanning direction (i.e., the longitudinal direction of FIG. 10) is 30 μm, which is nearly a half of the length of a single pixel. With the arrangement, the length in the sub scanning direction of the dot of the electrostatic latent image formed on the photoreceptor 9, can be changed from 30 μm to approximately 60 μm, i.e., the length of a single pixel, by controlling the luminescence time. By combining this change with the change of the luminescence area by the luminescence portions 36*a* through 36*g* in the main scanning direction (i.e., the lateral direction of FIG. 10), it is possible to realize a tone expression having plenty of tones.

Thus, in the copying machine of the present embodiment, the exposure device 8 is arranged so that the first luminescence portion 36*a*, which first emits light in each of the LEDs 36, is substantially the same size as, or greater than, the diameter of the toner particle.

In the case where the image data corresponding to the lightest density are inputted to the exposure device and the first luminescence portion emits light according to the image data, there is no adhesion of toner particle onto the photoreceptor, if the size of the first luminescence portion is smaller than the diameter of the toner particle.

With the arrangement of the present embodiment, however, the size of the first luminescence portion 36*a* is substantially the same size as, or greater than, the diameter of the toner particle. Accordingly, in the case where the image data corresponding to the lightest density of non-white level are inputted to the exposure device 8, the toner particle can certainly adhere to the photoreceptor 9, thereby realizing tone expression. Namely, it is possible to avoid the conventional problem that tone expression cannot be carried out in spite of the input of the image data.

Thus, it is possible to avoid the waste that light emitted by the first luminescence portion 36*a* does not contribute to tone expression. This results in the efficient drive of the LED 36 and the reduction of the number of wirings, which realize the compact exposure device 8 and the reduction in its fabrication cost.

Moreover, the exposure device 8 is arranged so that the respective sizes of the luminescence portions 36*b* through 36*g* are smaller than that of the first luminescence portion 36*a*.

With the arrangement, the size of the first luminescence portion 36*a* comparatively becomes great; so that the toner can certainly adhere onto the minimum dot of the electrostatic latent image formed on the photoreceptor 9. In addition, since the respective sizes of the luminescence portions 36*b* through 36*g* are comparatively small, there are provided many types of luminescence areas, which are different from each other in their sizes, between the minimum luminescence area and the maximum luminescence area. Accordingly, it is possible to realize many types of tone expressions in a single LED 36, i.e., for a single pixel.

Moreover, as described above, it is possible to change the size of the dot formed on the photoreceptor 9 in the sub scanning direction, too. Accordingly, it is possible to realize halftone expression having more tones by means of changing the luminescence area not only in the main scanning direction but also in the sub scanning direction.

Figure 11:
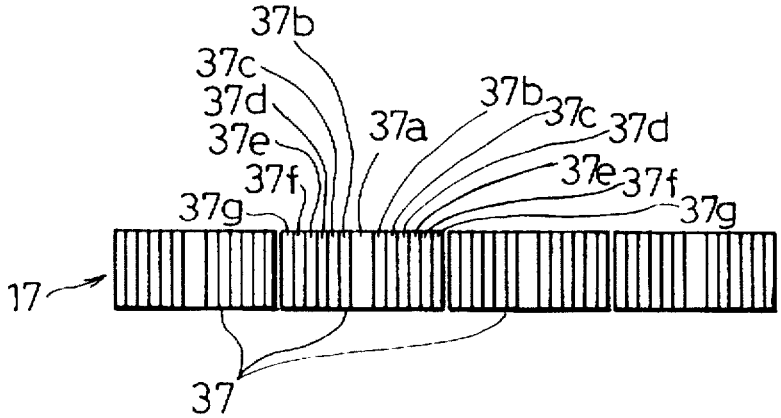
FIG. 11 is a plan view showing a still another type of LED in which the first luminescence portion is formed in a rectangular shape in the center of the LED.
Figure 12:
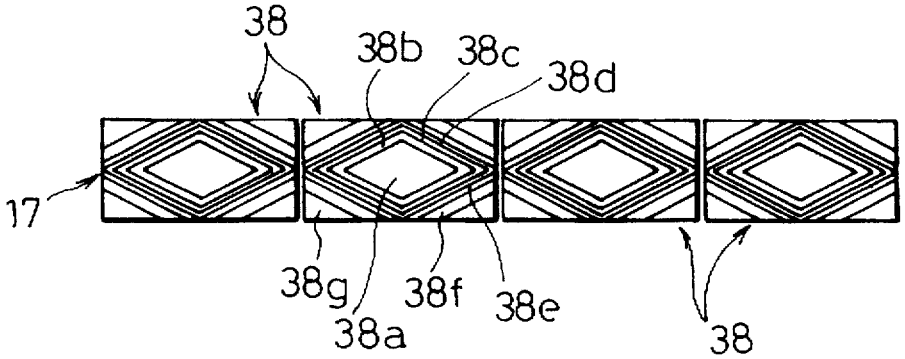
FIG. 12 is a plan view showing a still another type of LED in which the first luminescence portion is formed in a rhombus shape in the center of the LED.

The following description deals with a still another embodiment of the present invention with reference to FIGS. 11 and 12. For convenience, the member which have the same function as that of the foregoing first and second embodiments is denoted with the same reference numerals, and the detail explanations thereof are omitted.

The copying machine of the present embodiment is provided with the LED array 17 in which the first luminescence portion 37*a* of each LED 37 is arranged in the center of the LED 37 and the other luminescence portions 37*b* through 37*g* are respectively arranged in both sides of the first luminescence portion 37*a*, as shown in FIG. 11.

The shape of the first luminescence portion 37*a* is a rectangle or a square. The LED 37 is arranged so that the luminescence area increases equivalently in both sides of the first luminescence portion 37*a*. Namely, the luminescence area increases step by step from the center of the LED 37 to the both sides, with an increase in a voltage applied to the LED 37.

Thus, in the digital copying machine of the present embodiment, the exposure device 8 is arranged so that the first luminescence portion 37*a*, which is in the center of the LED 37, first emits light, when the voltage is applied to the LED 37 for the minimum luminescence of the LED 37, and the luminescence area of the LED 37 spreads over the both sides of the first luminescence portion 37*a* step by step, with an increase in the applied voltage.

Accordingly, the dot-size of the electrostatic latent image formed on the photoreceptor 9 can be enlarged orderly from the center toward the periphery, thereby improving the reproductivity of the toner image and realizing smooth tone expression.

The present invention is not limited to the present embodiment, but is modified in various ways within the scope of the invention. For example, as described above, the first luminescence portion 37*a*, formed in the center of the LED 37, has the shape of a rectangle or a square. its shape, however, is not limited to a rectangle or a square. For example, as shown in FIG. 12, the first luminescence portion 38*a* can be formed in a rhombus shape. In addition, the other luminescence portions 38*b* through 38*g* are arranged equivalently outside the four sides of the first luminescence portion 38*a*.

With the arrangement, the luminescence area can be enlarged, maintaining its shape as a rhombus, with an increase in a voltage applied to the LED 38. Furthermore, the luminescence portions 38*d* through 38*g* are arranged in contact with the margin of the LED 38 (i.e., the four sides of the LED 38). The total luminescence area by the luminescence portions 38*a* through 38*d* is just a half of the maximum luminescence area of the LED 38.

The main difference in the two arrangements shown in FIGS. 11 and 12 is as follows; if the LEDs 37 emit light in series along the main scanning direction and the luminescence area in each of the LEDs 37 is a half of the maximum luminescence area, the luminescence pattern is broken along the main scanning direction in the arrangement of FIG. 11, while, in such a case, the luminescence pattern is not broken along the main scanning direction in the arrangement of FIG. 12. This difference influences the reproductivity of a fine line along the main scanning direction. In the arrangement of FIG. 12, the fine line can be reproduced without a break along the main scanning direction when the luminescence area of each of the LEDs 38 is not less than a half of the maximum luminescence area. While, in the arrangement of FIG. 11, the fine line can be reproduced without a break along the main scanning direction only when the luminescence area of each of the LEDs 37 is the maximum luminescence area. Namely, the arrangement of FIG. 12 is more suitable for the reproductivity of the fine line along the main scanning direction.

In the arrangement of FIG. 12, the shape of the first luminescence area 38*a* and the half-sized luminescence area of each LED 38 is a rhombus. These areas, however, may be provided in other shapes such as a round shape, a elliptic shape or a polygon shape.

As described above, the LED 38 is arranged so that the luminescence area is in contact with the margin of the LED 38 (i.e., the four sides of the LED 38) when the luminescence area is not less than a half of the maximum luminescence area.

Therefore, in reproducing the fine line along the main scanning direction or the sub scanning direction, if the luminescence area of each of the LEDs 38 is not less than a half of the maximum luminescence area, the dots of the electrostatic latent image on the photoreceptor 9 by adjacent LEDs 38 are serially formed without a break along the main scanning direction or the sub scanning direction. Accordingly, the fine line can be serially reproduced without a break along the main scanning direction or the sub scanning direction, thereby realizing an excellent reproduction of a fine line.

The following description deals with a still another embodiment of the present invention with reference to FIGS. 13 through 16. For convenience, the members which have the same function as that of the foregoing first through third embodiments are denoted with the same reference numerals, and the detail explanations thereof are omitted.

Figure 13:
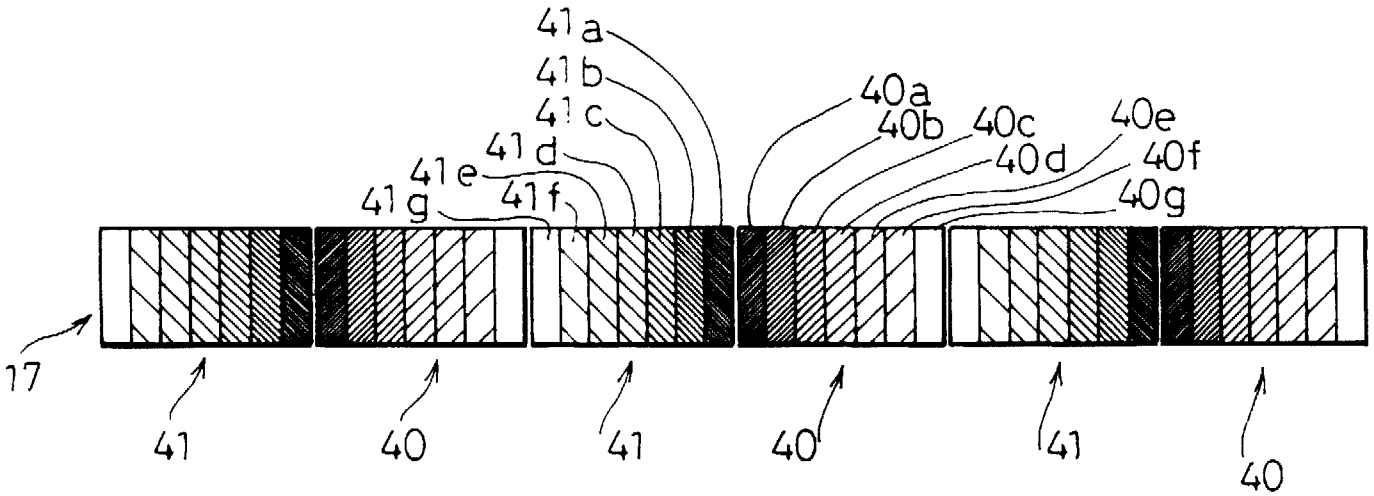
FIG. 13 is a plan view showing an LED array in which two LEDs make a pair, in accordance with a still another embodiment of the present invention.

In the copying machine of the present embodiment, the exposure device 8 is provided with the LED array 17 in which two types of LEDs, i.e., LEDs 40 and LEDs 41 make a pair and are alternately arranged along the main scanning direction, as shown in FIG. 13. The LED 40, which is one type of light emitting device, is arranged so that the first luminescence portion 40*a* is provided on the left side in the LED 40 and the other luminescence portions 40*b* through 40*g* are provided in this order toward the right side. The LED 41, which is the other type of light emitting device, is arranged so that the first luminescence portion 41*a* is provided on the right side of the LED 41 and the other luminescence portions 41*b* through 41*g* are provided in this order toward the left side.

With the arrangement, the first luminescence portions 40*a* and 41*a* are adjacent to each other every one pair, i.e., every two diodes (the LEDs 40 and 41). The luminescence area extends from the adjacent part of each pair of the two LEDs 40 and 41 to its both sides, with an increase in voltages applied to the respective luminescence portions 40*a* through 40*g* and 41*a* through 41*g* in the LEDs 40 and 41.

As a result, the dots of the electrostatic latent image on the photoreceptor 9 are formed so as to centralize every two pixels, and the toner adhesion is also centralized every two pixels, thereby achieving precise reproduction by the toner image.

As described above, adjacent two LEDs 40 and 41 make a pair. The LED 40 is arranged so that the luminescence area increases step by step from one side to the other side along the main scanning direction by the luminescence portions 40*a* through 40*g*, while the LED 41 is arranged so that the luminescence area increases step by step from the other side to one side along the main scanning direction by the luminescence portions 41*a* through 41*g*. Therefore, it is possible to increase the luminescence area in such a manner that the luminescence area extends from the connecting part of adjacent two LEDs 40 and 41 to its both sides along the main scanning direction, with an increase in the voltages applied to the LEDs 40 and 41.

According to the size of total luminescence area by adjacent two LEDs 40 and 41, the dot shape of the electrostatic latent image on the photoreceptor 9 changes so as to centralize up to the total maximum luminescence area for each pair of two LEDs 40 and 41.

Accordingly, it is possible to improve reproductivity by the toner image and to realize smooth tone expression.

The present invention is not limited to the present embodiment, but can be modified in various ways within the scope of the invention. For example, two adjacent LEDs may make a pair so as to correspond to a single pixel, and exposure to express half-tone may be performed by dither technique.

For convenience, the following discusses LEDs 42 and 43 which respectively have three luminescence portions, as shown in FIGS. 14(*a*) through 14(*g*). In the LEDs 42 and 43, the first luminescence portions 42*a* and 43*a* emit light according to the lowest applied voltage. The second luminescence portions 42*b* and 43*b* emit light according to the middle applied voltage and the third luminescence portions 42*c* and 43*c* emit light according to the highest applied voltage. Thus, the two LEDs 42 and 43 have totally six luminescence portions 42*a* through 42*c* and 43*a* through 43*c*, which are aligned along the main scanning direction.

Therefore, dither patterns by the dither technique are seven patterns including a pattern of no luminescence, as shown in FIGS. 14(*a*) through 14(*g*). In other words, it is possible to obtain seven stages of tones by the change of the size of the luminescence area by the two LEDs 42 and 43.

To generalize this, the number of tones obtained by the change of the size of the luminescence area is (m+1), when the number of the luminescence portions composing a single pixel is (m). In this case, the resolution in the main scanning direction is a half of that in the case where a single device (i.e., a single LED) corresponds to a single pixel. While the number of obtained tones becomes about double, as compared with that in the case where a single device corresponds to a single pixel.

Accordingly, it is possible to increase the number of obtained tones by increasing the number of the luminescence portions composing a single pixel. For example, it is possible to realize halftone expression having fifteen tones, when the exposure device 8 is arranged so that a single device has seven luminescence portions and a single pixel is composed of fourteen luminescence portions.

Alternatively, a dither pattern may be arranged so that a single pixel includes luminescence portions of the next line in the sub scanning direction, as shown in FIGS. 15(*a*) through 15(*m*).

Referring to FIGS. 15(*a*) through 15(*m*), the single pixel is composed of four devices, i.e., two lines of two LEDs 44 and 45. For convenience, the number of the luminescence portions in a single device, i.e., a single LED is three. Namely, the number of the luminescence portions of a single pixel is twelve. In this case, the resolution is a half of that in the case where a single device (i.e., a single LED) corresponds to a single pixel, in the sub scanning direction as well as in the main scanning direction. However, the number of reproducible tones becomes thirteen (i.e., 12+1).

The dither pattern shown in FIGS. 15(*a*) through 15(*m*) is one example, and the order of the luminescence in the LEDs 44 and 45 is not limited to the order of FIGS. 15(*a*) through 15(*m*). For example, the luminescence of the LEDs 44 may precede the luminescence of the LEDs 45.

Alternatively, dither pattern may be arranged so that the dither technique is combined with pulse width control in the sub scanning direction, as shown in FIGS. 16(*a*) through 16(*m*).

In this arrangement, the luminescence time is a half and the luminescence timing is twice faster, as compared with that shown in FIGS. 15(*a*) through 15(*m*).

With the arrangement, the dot size of the electrostatic latent image on the photoreceptor 9 becomes a half in the sub scanning direction and serial two luminescences correspond to the length of a single pixel in the sub scanning direction. Namely, a single pixel is divided into two luminescences. By combining such control with the dither technique, it is possible to realize halftone recording having double tones. Furthermore, it is possible to obtain the same number of tones as that obtained by the arrangement of FIGS. 15(*a*) through 15(*m*) without any reduction of resolution in the sub scanning direction, although resolution in the main scanning direction is reduced to a half as compared with that in the case where a single pixel corresponds to a single device. In addition, it is possible to obtain still more tones with resolution maintained, if the pulse width control of the sub scanning direction is three or more division.

As described above, dither pattern can be arranged according to the change of the size of the luminescence area in the LEDs. As a result, it is possible to arrange dither pattern with respect to every one pixel, and to realize tone expression by the control of the luminescence area. Therefore, the exposure device 8 does not require such a circuit as a correction circuit of luminous power, thereby easily realizing a compact exposure device 8 and a reduction in its costs. Moreover, it is possible to form an image having rich tones without any reduction of resolution.

In the case where exposure for halftone is performed by the dither technique in which two LEDs 40 and 41, adjacent to each other in the main scanning direction, make a pair, the number of tones can be increased by double, though resolution of the main scanning direction is decreased by a half. Moreover, the dots of the electrostatic latent image on the photoreceptor 9 are collectively formed every one pixel through the change of the size of the luminescence area by a pair of the LEDs 40 and 41, thereby improving the reproductivity of the toner image and realizing smooth tone expression.

In the case where exposure for halftone is performed by the dither technique in which a single pixel is composed of four devices, i.e., two adjacent lines of two LEDs 44 and 45 adjacent to each other in the main scanning direction, the number of tones can be increased by double in the sub scanning direction as well as in the main scanning direction, although the resolution is decreased by half in the both directions.

Furthermore, in the case where exposure for halftone is performed by the dither technique which is combined with the pulse width control of the sub scanning direction, the number of tones in the sub scanning direction can be still increased with the resolution maintained.

The following description deals with a still another embodiment of the present invention with reference to FIG. 3 and FIGS. 17 through 20. For convenience, the member which has the same function as that of the foregoing first through fourth embodiments is denoted as the same reference numeral, and the detail explanations thereof are omitted.

In the copying machine of the present embodiment, the exposure device 8 is provided with the LED array 17 in which each LED 50 includes sixteen luminescence portions, i.e., respective four luminescence portions in the main scanning direction and respective four luminescence portions in the sub scanning direction, as shown in FIGS. 17(*a*) and 17(*b*). In the sixteen luminescence portions 50*a* through 50*p*, the fifteenth luminescence portion 50*o* and the sixteenth luminescence portion 50*p* start to emit light by quite the same applied voltage. Therefore, the LED 50 is practically composed of fifteen luminescence portions. The reason why the LED 50 is arranged as described above is as follows; if the LED 50 is practically composed of sixteen luminescence portions, expression patterns of the image data require seventeen patterns including expression pattern for "white", in the transmission of the image data from the image signal processing circuit 7 to the exposure device 8. It is not efficient because the digital circuit operating by the binary system requires five bits in such a case. In addition, in high density area, the change of density corresponding to the signal becomes small because of attenuation of toner in the fusing process and so forth.

The LED 50 corresponds to a single pixel and its luminescence portions sequentially emit light from the first luminescence portion 50*a* to the sixteenth luminescence portion 50*p*, with an increase in the voltage applied thereto.

FIG. 18 shows the respective voltages required for luminescence in the respective luminescence portions 50*a* through 50*p*. If the applied voltage, i.e., forward voltage is not more than V1' [V], the LED 50 emits no light because there is no electric current through all the luminescence portions 50*a* through 50*p*. If the applied voltage is between V1' [V] and (V1'+dV') [IV], only the first luminescence portion 50*a* emits light by the forward electric current therethrough. Each time the applied voltage increases by the dV' [IV], another luminescence portion emits light. Thus, when the applied voltage increases, the luminescence portions 50*a* through 50*p* emit light sequentially so as to increase the luminescence area step by step.

The image data outputted from the image signal processing circuit 7 are three bits per a single pixel in the first embodiment, while the image data are four bits per a single pixel in the present embodiment because the LED 50 is practically composed of fifteen luminescence portions.

Accordingly, in the present embodiment, the shift register 21 and the latch circuit 22 have twenty thousand (i.e., 5000×4) of bits respectively, and there are fifteen transistors 24 per a single pixel, as shown in FIG. 19.

In addition, a signal line 51 for LED luminescence control connects the image signal processing circuit 7 with a base of a transistor 52 for LED luminescence control via the signal line 51.

The transistor 52 is switched on when the signal for LED luminescence control corresponds to "1". This enables each of the LEDs 50 to be driven by a voltage according to a value outputted from a decoder 53. Moreover, the collector of the transistor 52 is connected with the LEDs 50 for other pixels in parallel, so that luminescence of a plurality of LEDs 50 can be controlled and lighted at the same time.

The following describes operation of driver IC 54 arranged as described above with reference to a timing chart of FIG. 20.

The transmission of the image signal from the image signal processing circuit 7 starts at "t1". The transmission has finished at "t2" and the image latch signal 31 is outputted at "t3". The signal for LED luminescence control is outputted at "t4", just when the photoreceptor 9 stops rotating. The photoreceptor 9 can be driven in a stepping driven manner having very short time intervals based on the signal supplied from the image signal processing circuit 7 by a photoreceptor driving motor (not shown). By this type of driving, the photoreceptor 9 stops rotating as described above.

Just when irradiation to the photoreceptor 9 by the LED 50 has finished, the photoreceptor 9 starts rotating at "t5". The next image signal is transmitted during irradiation to the photoreceptor 9 by the LED 50.

As described above, the driving of the photoreceptor 9 and the luminescence of the LED 50 are alternately carried out; so that the luminescence of the LED 50 in dither pattern is projected onto the photoreceptor 9 with its shape maintained so as to form the electrostatic latent image on the photoreceptor 9. Accordingly, it is possible to realize tone reproduction of an image without any reduction of resolution.

Compare the respective driving voltages shown in FIG. 18 in the case of sixteen luminescence portions, with the respective driving voltages shown in FIG. 3(*b*) in the case of seven luminescence portions. If V1 is equal to V1' and dV is equal to dV', the voltages of V2 and V2' are as follows.

$$V2=6\ dV+V1$$

$$V2'=14\ dV+V1$$

It is evident from the above equations that V2' is greater than V2.

Referring to FIG. 3(*b*), if the maximum allowable voltage for the first luminescence portion 16*a*, which first emits light by the driving voltage V1, is (V1+10 dV) [V], the driving voltage V2 falls within the maximum allowable voltage. In such a case, however, the first luminescence portion 50*a* is broken down when the eleventh luminescence portion 50*k* emits light, as shown in FIG. 18.

In order to prevent this break down, (1) the luminescence starting voltage of each of the luminescence portions 50*a* through 50*o* is adjusted by a control of composition of materials composing the LED 50 and (2) voltages applied to the first standard voltage terminal 26 and the second standard voltage terminal 27 are properly adjusted. Thus, the above described break down can be avoided.

As described above, the change of driving voltage required for the step-by-step change of the size of the luminescence area is set within such a narrow range that the driving voltage for the maximum luminescence area of the LED 50 exerts no bad influence on LED characteristics. Accordingly, it is possible to realize wider tone expression without causing any break down of the LED, with the full use of allowable voltage range for LED driving. In addition, it is possible to minimize the scale and size of various circuits within the exposure device 8 because the information volume of signals and the number of signal lines necessary for the transmission of the image data to the LED can be reduced to a minimum.

The following description deals with a still another embodiment of the present invention with reference to FIGS. 17, 20 and 21. For convenience, members which have the same function as that of the foregoing first through fifth embodiments are denoted as with the same reference numerals, and the detailed explanations thereof are omitted.

The copying machine of the present embodiment is provided with the photoreceptor 9 which constantly rotates at a fixed speed. The timing of the image signal and the image latch signal 31 are the same as those of the fifth embodiment.

Take notice of the first luminescence portion 50*a* and the thirteenth luminescence portion 50*m* shown in FIG. 17(*b*). The first luminescence portion 50*a* is adjacent to the thirteenth luminescence portion 50*m* and is on the upstream side of the thirteenth luminescence portion 50*m*, as seen from the rotation direction of the photoreceptor 9.

Among the exposure area by the first luminescence portion 50*a*, the portion in the vicinity of the boundary between the thirteenth luminescence portion 50*m* and the first luminescence portion 50*a*, enters into the exposure area of the thirteenth luminescence portion 50*m* as soon as the the LED 50 emits light, because the photoreceptor 9 constantly rotates at a fixed speed. As a result, it occurs that exposure overlaps among adjacent luminescence portions in the sub scanning direction.

In order to reduce this exposure overlap, the following method can be adopted. The LED 50 is switched off when the exposure area on the photoreceptor 9 has moved from the portion in contact with the boundary of the first luminescence portion 50*a* and the thirteenth luminescence portion 50m, to the middle part (i.e., 50 percent of the whole portion) of the thirteenth luminescence portion 50m. By adopting this method, the exposure overlap among the first luminescence portion 50a and the thirteenth luminescence portion 50m can be diminished to half, while tone reproduction is kept excellent.

Namely, as shown in FIG. 21, the LED 50 is driven so as to make the timing of switching off the LED 50 (i.e., "t5''') more quickly, as compared with the driving of FIG. 20. This enables exposure overlap among adjacent luminescence portions in the sub scanning direction to be sufficiently diminished.

By adopting the above described method, it is possible to precisely form the electrostatic latent image since the photoreceptor 9 has high sensitivity and high gamma (γ) characteristics.

As described above, in the copying machine of the present embodiment, the relation between the rotary speed of the photoreceptor 9 and the luminescence period of the respective luminescence portions 50a through 50p is set so that the exposure overlap among adjacent luminescence portions in the sub scanning direction, like the first luminescence portion 50a and the thirteenth luminescence portion 50m, is at least within fifty percent of the whole luminescence portion.

In this way, it is possible to divide the LED 50 into a plurality of luminescence areas in the sub scanning direction as well as in the main scanning direction. This enables the LED 50 to easily obtain many luminescence areas enough to realize wider tone expression, thereby realizing rich tone expression. In addition, it is possible to fabricate the exposure device 8 with ease and to reduce the fabrication costs of the exposure device 8.

There are described above novel features which the skilled man will appreciate give rise to advantages. These are each independent aspects of the invention to be covered by the present application, irrespective of whether or not they are included within the scope of the following claims.

What is claimed is:

1. An image forming apparatus comprising:

a photoreceptor; and exposure means for exposing said photoreceptor based on image data so as to form an electrostatic latent image on said photoreceptor, said exposure means including a plurality of light emitting devices aligned in a main scanning direction of said photoreceptor, the plurality of light emitting devices each having a plurality of luminescence portions, and light emitting device driving means for applying respective voltages to the plurality of light emitting devices in accordance with the image data so that respective luminescence areas of the plurality of light emitting devices increase step by step each time the respective applied voltages increase by a predetermined voltage.

2. The image forming apparatus as set forth in claim 1, wherein the plurality of light emitting devices are light emitting diodes.

3. The image forming apparatus as set forth in claim 1, wherein respective first luminescence portions of the plurality of light emitting devices which first emit light each have a respective luminescence area of not less than a diameter of a toner particle.

4. The image forming apparatus as set forth in claim 1, wherein the respective luminescence areas of the plurality of light emitting devices increase step by step so as to spread from respective central parts of the plurality of light emitting devices toward peripheries thereof.

5. The image forming apparatus as set forth in claim 4, wherein the respective luminescence areas are in contact with four sides of respective ones of the plurality of light emitting devices, when the respective luminescence areas are not less than half of a maximum luminescence area of the plurality of light emitting devices.

6. The image forming apparatus as set forth in claim 5, wherein respective first luminescence portions of the plurality of light emitting devices which first emit light are each provided in central parts of the plurality of light emitting devices, a shape of the respective first luminescence portions being a rhombus.

7. The image forming apparatus as set forth in claim 1, wherein at least adjacent two types of light emitting devices respectively make a set among the plurality of light emitting devices provided in said exposure means, a first type of light emitting device having respective luminescence portions arranged so that a luminescence area increases in a first direction along the main scanning direction and a second type of light emitting device having respective luminescence portions arranged so that a luminescence area increases in a second direction opposite to the first direction.

8. The image forming apparatus as set forth in claim 7, wherein four of the plurality of light emitting devices form a set so as to correspond to a single pixel, two of the first and second types of light emitting diodes in adjacent two lines forming a set.

9. The image forming apparatus as set forth in claim 7, wherein a single pair of the adjacent two types of light emitting devices corresponds to a single pixel.

10. The image forming apparatus as set forth in claim 9, wherein luminescence time of the plurality of light emitting devices is controlled so that two serial luminescences of the plurality of light emitting devices correspond to a length of a single pixel in a sub scanning direction orthogonal to the main scanning direction.

11. The image forming apparatus as set forth in claim 1, further comprising an optical filter provided between the plurality of light emitting devices and said photoreceptor, said optical filter having characteristics such that a transmission ratio decreases according to a change of a luminescence wavelength due to an increase in luminous power of the plurality light emitting devices.

12. The image forming apparatus as set forth in claim 1, wherein each of the plurality of light emitting devices has a plurality of luminescence portions at least in the main scanning direction.

13. The image forming apparatus as set forth in claim 1, wherein each of the plurality of light emitting devices has a plurality of luminescence portions at least in a sub scanning direction orthogonal to the main scanning direction.

14. The image forming apparatus as set forth in claim 1, wherein each of the plurality of light emitting devices has seven luminescence portions.

15. The image forming apparatus as set forth in claim 1, wherein each of the plurality of light emitting devices has sixteen luminescence portions of which two luminescence portions have equal luminescence starting voltages.

16. The image forming apparatus as set forth in claim 1, wherein said photoreceptor is driven so as to intermittently rotate and to stop during luminescence periods of the plurality of light emitting devices.

17. The image forming apparatus as set forth in claim 1, wherein said photoreceptor is driven so as to constantly rotate, luminescence periods of the plurality of light emitting devices being adjusted to a rotary speed of said photoreceptor so that exposure overlap on said photoreceptor among adjacent two luminescence portions of the plurality of light emitting devices in a sub scanning direction is not more than fifty percent of an entire luminescence portion.

18. A method of imaging comprising:

a) aligning a plurality of light emitting devices in a main scanning direction along a photoreceptor, the plurality of light emitting devices each having a plurality of luminescence portions;

b) driving the plurality of light reemitting devices with respective voltages in accordance with image data so that respective luminescence areas of the plurality of light emitting devices increase step by step each time the respective applied voltages increase by a predetermined voltage; and c) exposing the photoreceptor with light emitted from the plurality of light emitting devices in said step b) to form an electrostatic latent image on the photoreceptor.

19. The method of imaging of claim 18, wherein the respective luminescence areas of said step b) increase so as to spread from respective central parts of the plurality of light emitting diodes toward peripheries thereof.

20. The method of imaging of claim 19, wherein said step b) comprises driving the plurality of light emitting diodes such that the respective luminescence areas are in contact with four side edges of respective ones of the plurality of light emitting devices when the respective luminescence areas are not less than half of a maximum luminescence area of the plurality of light emitting devices.

21. The method of imaging of claim 20, wherein respective first luminescence portions of the plurality of light emitting devices which first emit light are each provided in central parts of the plurality of light emitting devices, the respective first luminescence portions being rhombus-shaped.

22. The method of imaging of claim 18, wherein said step a) comprises aligning at least two types of light emitting devices adjacent to each other as a set, a first type of light emitting device having respective luminescence portions arranged so that a luminescence area thereof increases in a first direction along the main scanning direction and a second type of light emitting device having respective luminescence portions arranged so that a luminescence area thereof increases in a second direction opposite to the first direction.

23. The method of imaging of claim 22, wherein a single pair of the first and second types of light emitting devices as a set corresponds to a single pixel.

24. The method of imaging of claim 22, wherein two respective pairs of the first and second types of light emitting devices in adjacent lines correspond to a single pixel.

25. The method of imaging of claim 18, wherein step b) comprises driving the plurality of light emitting diodes such that respective first luminescence portions which first emit light each have a respective luminescence area of not less than a diameter of a toner particle used during imaging.

26. The method of imaging of claim 18, further comprising the step of filtering the light emitted during said step b) such that a transmission ratio decreases in accordance with a change of a luminescence wavelength due to an increase in luminous power of the plurality of light emitting devices.

27. The method of imaging of claim 18, wherein said step a) comprises aligning a plurality of light emitting devices each having a plurality of luminescence portions at least in the main scanning direction.

28. The method of imaging of claim 18, wherein said step a) comprises aligning a plurality of light emitting devices each having a plurality of luminescence portions in a subscanning direction orthogonal to the main scanning direction.

29. The method of imaging of claim 18, wherein said step a) comprises aligning a plurality of light emitting devices each having seven luminescence portions.

30. The method of imaging of claim 18, wherein said step a) comprises aligning a plurality of light emitting devices each having sixteen luminescence portions of which two luminescence portions have equal luminescence starting voltages.

31. The method of imaging of claim 18, further comprising the step of driving the photoreceptor to intermittently rotate and to stop during luminescence periods of the plurality of light emitting devices during said step b).

32. The method of imaging of claim 18, further comprising the step of driving the photoreceptor so as to constantly rotate during said step b), luminescence periods of the plurality of light emitting devices being adjusted to a rotary speed of the photoreceptor so that exposure overlap on the photoreceptor among two adjacent luminescence portions of the plurality of light emitting devices in a subscanning direction is not more than fifty percent of an entire luminescence portion.

* * * * *